US006827624B2

(12) United States Patent
Kurokawa et al.

(10) Patent No.: US 6,827,624 B2
(45) Date of Patent: Dec. 7, 2004

(54) ELECTRON EMISSION ELEMENT AND METHOD FOR PRODUCING THE SAME

(75) Inventors: Hideo Kurokawa, Katano (JP); Tetsuya Shiratori, Osaka (JP); Toshifumi Sato, Nara (JP); Masahiro Deguchi, Hirakata (JP); Makoto Kitabatake, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 77 days.

(21) Appl. No.: 10/196,032

(22) Filed: Jul. 15, 2002

(65) Prior Publication Data

US 2002/0193039 A1 Dec. 19, 2002

Related U.S. Application Data

(62) Division of application No. 09/402,899, filed as application No. PCT/JP98/01642 on Apr. 9, 1998, now Pat. No. 6,445,114.

(30) Foreign Application Priority Data

Apr. 9, 1997 (JP) ..... 9-90660
Aug. 27, 1997 (JP) ..... 9-230587
Oct. 30, 1997 (JP) ..... 9-298271

(51) Int. Cl.[7] ..... H01J 9/00; H01J 9/02

(52) U.S. Cl. ..... 445/50; 445/49; 445/51; 445/24

(58) Field of Search ..... 445/24, 25, 49, 445/50, 51; 313/309, 310, 311

(56) References Cited

U.S. PATENT DOCUMENTS

| | | | | |
|---|---|---|---|---|
| 5,066,883 | A | | 11/1991 | Yoshioka et al. |
| 5,289,086 | A | | 2/1994 | Kane |
| 5,588,894 | A | | 12/1996 | Jin et al. |
| 5,616,368 | A | | 4/1997 | Jin et al. |
| 5,619,092 | A | | 4/1997 | Jaskie ..... 313/309 |
| 5,619,903 | A | | 4/1997 | Rogers et al. |
| 5,681,196 | A | | 10/1997 | Jin et al. |
| 5,709,577 | A | * | 1/1998 | Jin et al. ..... 445/24 |
| 5,753,997 | A | | 5/1998 | Jaskie |
| 5,757,114 | A | | 5/1998 | Jaskie |

FOREIGN PATENT DOCUMENTS

| | | |
|---|---|---|
| JP | 1-97354 | 10/1987 |
| JP | 1-200532 | 4/1988 |
| JP | 2-192638 | 7/1990 |
| JP | 6-187900 | 7/1994 |
| JP | 6-318428 | 8/1994 |
| JP | 7-97473 | 10/1995 |
| JP | 7-123023 | 12/1995 |
| JP | 8-241665 | 8/1996 |
| JP | 9-17325 | 1/1997 |

OTHER PUBLICATIONS

International Search Report regarding International Application No. PCT/JP98/01642 mailed Aug. 18, 1998.

Supplementary European Search Report regarding European Application No. EP 98 91 2744 dated Dec. 12, 2000.

International Preliminary Examination Report regarding International Application No. PCT/JP98/01642 dated Jun. 29, 1999.

* cited by examiner

*Primary Examiner*—Nimeshkumar D. Patel
*Assistant Examiner*—Mariceli Santiago
(74) *Attorney, Agent, or Firm*—Renner, Otto, Boisselle & Sklar, LLP

(57) ABSTRACT

The first basic structure of the electron emission element of the present invention includes at least two electrodes disposed in a horizontal direction at a predetermined interval, and a plurality of electron emission portions made of a particle or an aggregate of the particles dispersively disposed between the electrodes. On the other hand, the second basic structure of the electron emission element of the present invention includes at least two electrodes disposed at a predetermined interval, a conductive layer disposed between the electrodes so as to be electrically connected thereto, and a plurality of electron emission portions made of a particle or an aggregate of the particles dispersively disposed on the surface of the conductive layer between the electrodes. According to these structures, an electron emission element with high stability can be obtained, in which emissions can be emitted efficiently and uniformly even in the absence of a bias voltage (electric field) from outside in an output (emission) direction of the electrons, by utilizing a transverse electric field generated between the electrodes disposed in a horizontal direction at a predetermined interval or an in-plane electric current flowing through the conductive layer disposed between the electrodes.

26 Claims, 15 Drawing Sheets

ELECTRON EMISSION ELEMENT AND METHOD FOR PRODUCING THE SAME

This application is a divisional of U.S patent application Ser. No. 09/402,899, filed on Dec. 10, 1999, now U.S. Pat. No. 6,445,114, which is a National Stage of International Application No. PCT/JP98/01642, filed Apr. 9, 1998.

TECHNICAL FIELD

The present invention relates to an electron emission element for emitting electrons and a method for producing the same. In particular, the present invention relates to an electron emission element formed by using diamond particles and a method for producing the same. Furthermore, the present invention relates to an electron emission source constructed by using a plurality of electron emission elements and an image display apparatus utilizing the same.

BACKGROUND ART

In recent years, as an electron beam source replacing an electron gun for a thin display with high definition and an electron source of a vacuum microelectronic device capable of operating at a high speed, a micro-electron emission element of a micron size has been paid attention to. There are various types of electron emission elements. In general, a field emission type (FE type), a tunnel injection type (MIM type or MIS type), a surface conduction type (SCE type), or the like have been reported.

In the FE type electron emission element, a voltage is supplied to a gate electrode to apply an electric field to an electron emission portion, whereby electrons are emitted from a cone-shaped projected portion formed of silicon (Si) or molybdenum (Mo). In the MIM type or MIS type electron emission element, a layered structure including metal, an insulating layer, a semiconductor layer, and the like is formed, and electrons are injected to and passed through the insulating layer from the metal layer by utilizing a tunnel effect, whereby electrons are output from an electron emission portion. Furthermore, in the SCE type electron emission element, an electric current is allowed to flow in an in-plane direction of a thin film formed on a substrate, and electrons are emitted from a previously formed electron emission portion (generally, a microcrack portion present in a conducting region of the thin film).

Any of the above-mentioned elements are characterized in that their structures can be miniaturized and integrated by using a micro-processing technique.

In general, it is required that a material for an electron emission portion of an electron emission element has characteristics of: (1) being likely to emit electrons in a relatively small electric field (i.e., being capable of emitting electrons efficiently), (2) having good stability of an electric current to be obtained, (3) having a small change in electron emission characteristics with passage of time, and the like. However, in the above-mentioned conventional electron emission elements which have been reported, their operating characteristics are largely dependent upon the shape of an electron emission portion, and greatly change with passage of time. Furthermore, it is difficult to produce such electron emission elements with good reproducibility, and it is very difficult to control their operation characteristics.

As is understood from the above, a structure of a conventional electron emission element or a structure and a material of an electron emission portion included therein do not satisfy required characteristics sufficiently.

The present invention has been achieved so as to overcome the above-mentioned problems, and its objective is to provide: (1) an electron emission element with high stability, capable of emitting electrons efficiently, by dispersing a plurality of electron emission portions made of a particle or an aggregate of particles; (2) a high-efficiency electron emission source and an image display apparatus using the same, by disposing a plurality of the above-mentioned electron emission elements; (3) an electron emission element and an electron emission source capable of emitting electrons efficiently, in particular, by using diamond particles for an electron emission member; (4) an image display apparatus comprised of an electron emission source including a plurality of electron emission elements capable of emitting electrons efficiently and an image forming member, and a flat display for displaying a bright and stable image; (5) a production method capable of easily and efficiently conducting an important production process with respect to diamond particles used for an electron emission portion in an electron emission element of the present invention; and (6) a method for producing an electron emission element capable of producing an electron emission element having an electron emission portion, which stably operates, over a large area with ease and good reproducibility, by conducting a step of uniformly distributing diamond particles.

DISCLOSURE OF THE INVENTION

An electron emission element of the present invention includes: a pair of electrodes disposed in a horizontal direction at a predetermined interval: and a plurality of electron emission portions disposed so as to be dispersed between the pair of electrodes.

In an embodiment, the above-mentioned electron emission element further includes a substrate having an insulating surface, wherein the pair of electrodes and the plurality of electron emission portions are disposed on the insulating surface of the substrate. More specifically, electrons move from one of the electrodes to the other electrode so as to hop through the plurality of electron emission portions by a transverse electric field generated between the pair of electrodes.

In another embodiment, the above-mentioned electron emission element further includes a conductive layer disposed between the pair of electrodes and electrically connected thereto, wherein the plurality of electron emission portions are disposed on the conductive layer. For example, the pair of electrodes can be provided as partial regions on ends of the conductive layer. Alternatively, the pair of electrodes and the conductive layer are made of different materials. In any case, electrons move from one of the electrodes to the other electrode by an electric current flowing through an inside of the conductive layer in an in-plane direction.

The conductive layer can be heated when an electric current flows through an inside of the conductive layer in an in-plane direction.

An amount of electron emission can be modulated by controlling an amount of the electric current flowing through an inside of the conductive layer in an in-plane direction.

Preferably, a dispersion density of the plurality of electron emission portions is about $1\times10^9/cm^2$ or more.

Preferably, the plurality of electron emission portions are independent relative to one another without coming into contact with each other.

Each of the plurality of electron emission portions is made of a particle of a predetermined material or an aggregate of the particles.

Preferably, an average particle diameter of the particles included in each of the plurality of electron emission portions is about 10 $\mu$m or less.

The predetermined material is diamond or a material mainly containing diamond.

The above-mentioned electron emission element includes a structure in which atoms on an outermost surface of the diamond or the material mainly containing diamond are terminated by binding to hydrogen atoms. Preferably, an amount of the hydrogen atoms binding to the atoms on the outermost surface is about $1\times10^{15}/cm^2$ or more.

The diamond or the material mainly containing diamond has crystal defects. Preferably, a density of the crystal defects is about $1\times10^{13}/cm^3$ or more.

The diamond or the material mainly containing diamond has a non-diamond component which is less than about 10% by volume.

The particles of the predetermined material are diamond particles produced by crushing a diamond film formed by a vapor-phase synthesis method. For example, the vapor-phase synthesis method is a plasma jet CVD method.

The conductive layer is a metal layer or an n-type semiconductor layer.

Preferably, a thickness of the conductive layer is about 100 nm or less.

Preferably, an electric resistance of the conductive layer is higher than an electric resistance of the electron emission portions.

An electron emission source includes a plurality of electron emission elements arranged in a predetermined pattern in such a manner as to emit electrons in accordance with an input signal to each of the electron emission elements, and each of the plurality of electron emission elements is the element having the above-mentioned characteristics.

Preferably, the above-mentioned electron emission source further includes a plurality of lines in a first direction electrically insulated from each other and a plurality of lines in a second direction electrically insulated from each other, wherein the plurality of lines in the first direction and the plurality of lines in the second direction are disposed in directions so as to be orthogonal to each other, and each of the electron emission elements is disposed in the vicinity of each intersection between the lines in the first direction and the lines in the second direction.

An image display apparatus provided according to the present invention includes an electron emission source and an image forming member for forming an image upon irradiation with electrons emitted from the electron emission source, wherein the electron emission source has the above-mentioned characteristics.

A method for producing an electron emission element of the present invention includes the steps of: disposing a pair of electrodes in a horizontal direction at a predetermined interval; and dispersively disposing a plurality of electron emission portions between the pair of electrodes.

In an embodiment, the above-mentioned production method further includes the step of providing a substrate having an insulating surface, wherein the pair of electrodes and the plurality of electron emission portions are disposed on the insulating surface of the substrate.

Furthermore, the above-mentioned production method further includes the step of providing a conductive layer between the pair of electrodes so as to be electrically connected thereto, wherein the plurality of electron emission portions are disposed on the conductive layer.

The pair of electrodes can be provided as partial regions on ends of the conductive layer. Alternatively, the pair of electrodes and the conductive layer are made of different materials.

The above-mentioned dispersively disposing step includes the step of dispersively disposing particles of a predetermined material or an aggregate of the particles as the plurality of electron emission portions.

For example, the above-mentioned dispersively disposing step includes the steps of: applying a solution or a solvent in which the particles of the predetermined material are dispersed; and removing the solution or the solvent. Alternatively, the above-mentioned dispersively disposing step includes the step of applying an ultrasonic vibration in a solution or a solvent in which the particles of the predetermined material are dispersed.

The predetermined material is diamond or a material mainly containing diamond.

In this case, the dispersively disposing step may include the step of distributing the diamond particles using a solution in which diamond particles are dispersed. Alternatively, the above-mentioned distributing step includes the step of applying an ultrasonic vibration in the solution in which the diamond particles are dispersed.

Preferably, an amount of the diamond particles dispersed in the solution is about 0.01 g to about 100 g per liter of the solution. Alternatively, the number of the diamond particles dispersed in the solution is about $1\times10^{16}$ to about $1\times10^{20}$ per liter of the solution.

Preferably, a pH value of the solution in which the diamond particles are dispersed is about 7 or less.

The solution in which the diamond particles are dispersed may contain at least fluorine atoms. Alternatively, the solution in which the diamond particles are dispersed contains at least hydrofluoric acid or ammonium fluoride.

In an embodiment, the above-mentioned production method further includes the step of allowing atoms on an outermost surface of the diamond particles to bind to hydrogen atoms.

Diamond particles heat-treated at about 600° C. or more in an atmosphere containing hydrogen gas can be used in the hydrogen binding step. Alternatively, the hydrogen binding step may include the step of heating the diamond particles at 600° C. or more in an atmosphere containing hydrogen or the step of irradiating with ultraviolet light.

Alternatively, the hydrogen binding step may include the step of exposing the diamond particles to plasma containing at least hydrogen under a state where a temperature of the diamond particles is about 300° C. or more.

In an embodiment, the above-mentioned production method further includes the step of introducing crystal defect into the diamond particles.

Diamond particles of which surfaces are irradiated with accelerated particles can be used in the defect introducing step. Alternatively, the defect introducing step includes the step of irradiating the diamond particles with accelerated atoms.

In an embodiment, the above-mentioned production method further includes the step of additionally growing diamond on the distributed diamond particles.

A vapor-phase synthesis process of diamond can be used in the additional growth step.

A method for producing an electron emission source provided according to the present invention includes the steps of: arranging a plurality of electron emission elements in a predetermined pattern in such a manner that the electron emission elements emit electrons in accordance with an input signal to each of the electron emission elements: and forming each of the plurality of electron emission elements by the production method having the above-mentioned characteristics.

The above-mentioned method for producing an electron emission source includes the steps of: disposing a plurality of lines in a first direction electrically insulated from each other and a plurality of lines in a second direction electrically insulated from each other in such a manner that the plurality of lines in the first direction and the plurality of lines in the second direction are orthogonal to each other; and disposing each of the electron emission elements in the vicinity of each intersection between the lines in the first direction and the lines in the second direction.

A method for producing an image display apparatus provided according to the present invention includes the steps of: constructing an electron emission source; and disposing an image forming member for forming an image upon irradiation with electrons emitted from the electron emission source, wherein the electron emission source is constructed by the production method having the above-mentioned characteristics.

BEST MODE FOR CARRYING OUT THE INVENTION

Figure 1A:
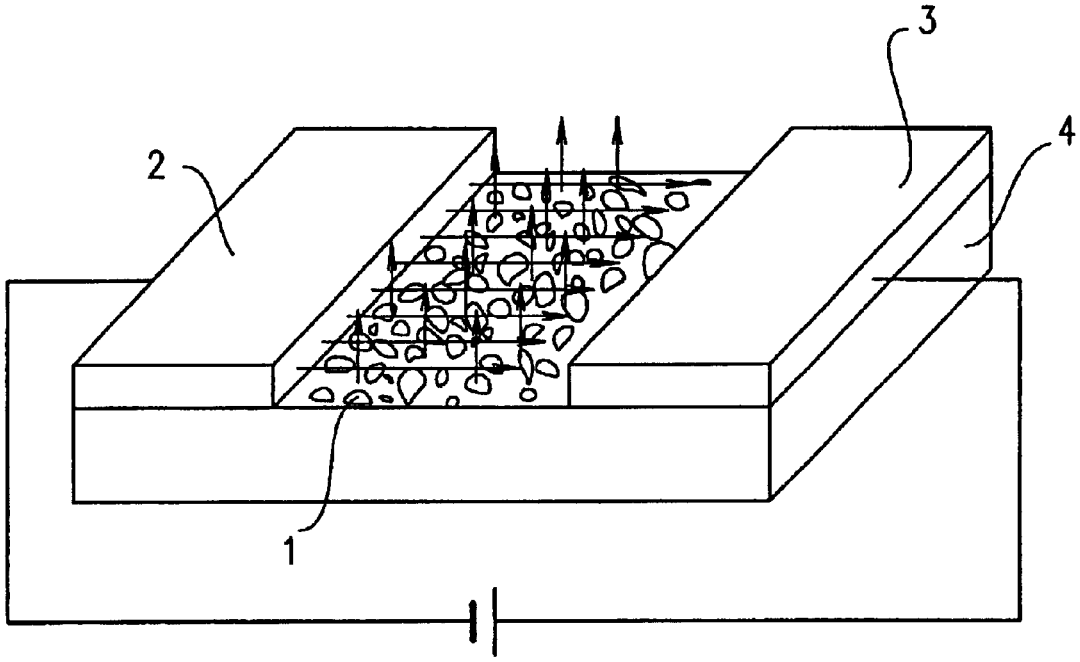
FIG. 1A is a perspective view schematically showing a structure of an electron emission element having a first basic structure according to the present invention.

Hereinafter, the present invention will be described with reference to the drawings. In the drawings, like reference numerals refer to like parts throughout the drawings. Thus, overlapping description may be omitted.

In order to realize a high-efficiency electron emission element, it is important to consider a design of an element structure and a material for the element which facilitate emission of electrons. Furthermore, from a practical point of view, it is desirable to produce an electron emission element at a low cost. According to the present invention, an electron emission element is realized, which is easily produced and is capable of emitting electrons with high efficiency and surface-emitting, by using particles and an aggregate of particles for an electron emission portion. In particular, diamond or a material mainly containing diamond (particle or aggregate of particles) are used as a constituent material (electron emission material) of the electron emission portion to control the surface state of the electron emission portion, whereby a number of electrons are emitted at a low applied electric power (consumption power).

Embodiment 1

In the first basic structure of the electron emission element according to the present invention, there are at least two electrodes disposed in a horizontal direction at a constant interval, and a plurality of electron emission portions made of a particle or an aggregate of particles disposed so as to be dispersed between the electrodes. FIG. 1A is a perspective view schematically showing a structure of an electron emission element in an embodiment in accordance with the first basic structure of the present invention.

More specifically, in the structure shown in FIG. 1A, two electrodes 2 and 3 are disposed on the surface of an insulating substrate 4 at a constant interval in a horizontal direction. On the surface of the insulating substrate 4 between the electrodes 2 and 3, a plurality of electron emission portions 1 each being made of a particle or an aggregate of particles are dispersed. When a bias voltage is applied across the electrodes 2 and 3, a transverse electric field is generated between the electrodes 2 and 3, and electrons move from a negative electrode 2 to a positive electrode 3 through the electron emission portions 1 (so as to hop between the plurality of electron emission portions 1) due to the effect of the transverse electric field, as schematically represented by arrows in the horizontal direction in FIG. 1A. Electrons emitted from each electron emission portion 1 are accelerated by the transverse electric field between the electrodes 2 and 3 while moving to an adjacent electron emission portion 1.

Furthermore, in the course of the above-mentioned movement, a part of electrons which are emitted from an electron emission portion 1 to reach an adjacent electron emission portion 1 are output in a direction away from the surface of the insulating substrate 4, for example, due to elastic scattering when reaching the adjacent electron emission portion 1. In FIG. 1A, the direction in which electrons are output are schematically represented by arrows in a vertical direction. However, electrons are not always output substantially in a direction vertical to the surface of the insulating substrate 4. In this case, as shown in FIG. 1B, a third electrode (extraction electrode) 5 is provided so as to face the insulating substrate 4, and a positive bias voltage is applied to the third electrode 5, electrons are output substantially in one direction, and an output efficiency is enhanced.

Figure 1B:
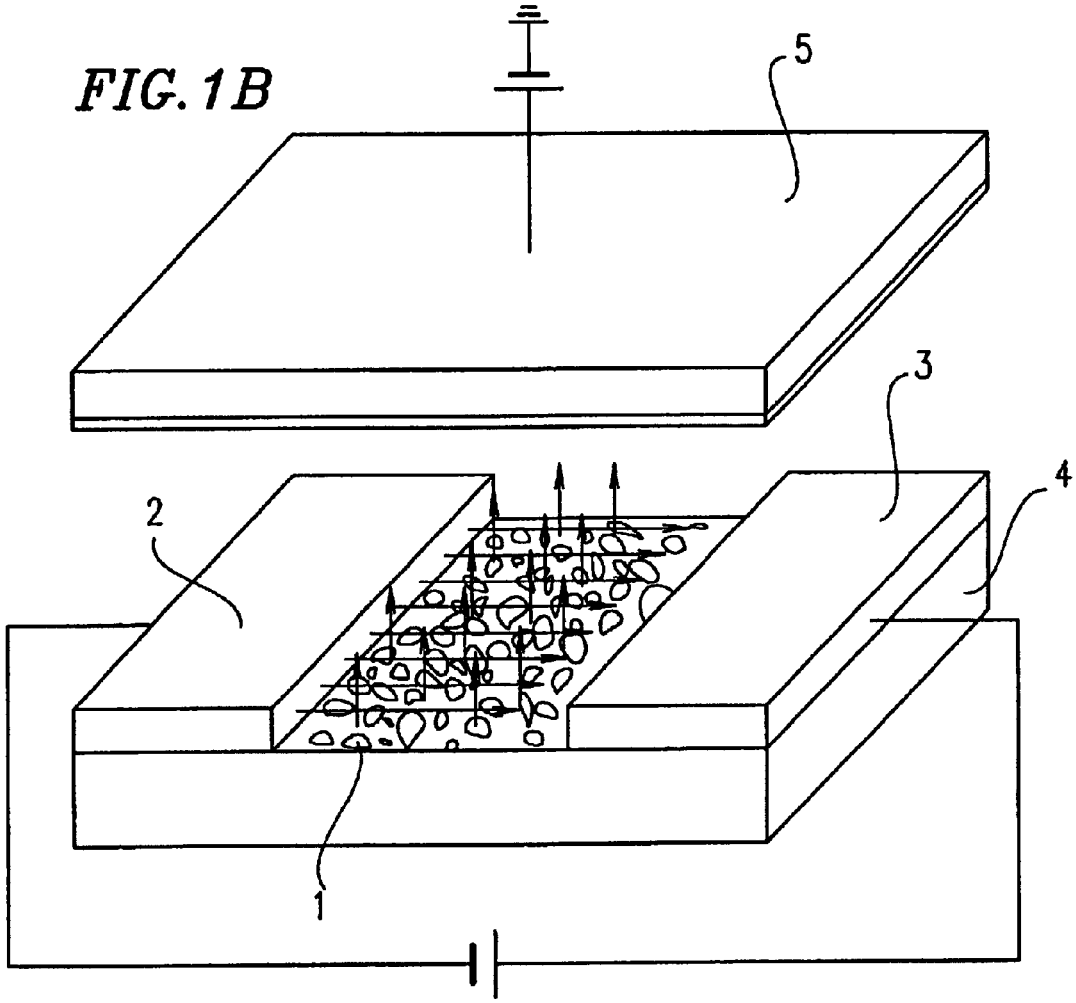
FIG. 1B is a perspective view schematically showing another structure of an electron emission element having a first basic structure according to the present invention.
Figure 2:
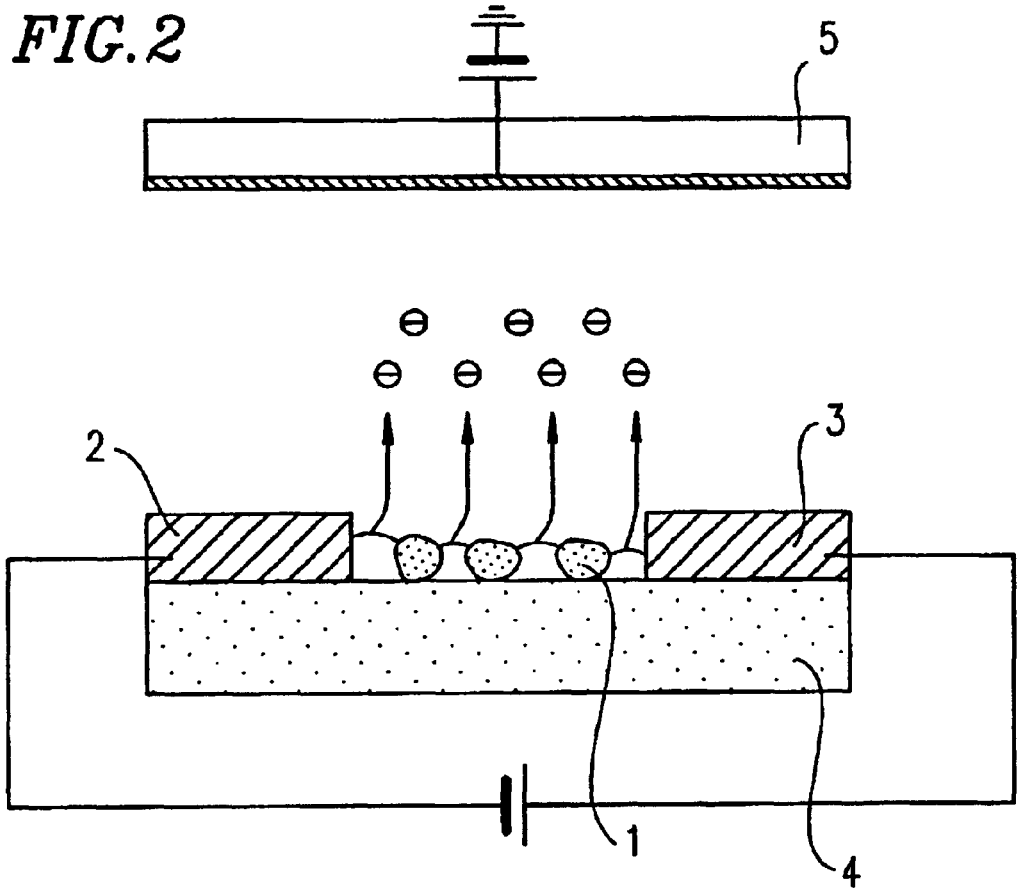
FIG. 2 is a cross-sectional view schematically showing the structure shown in FIG. 1B, schematically showing an idea of electron emission in an electron emission element having a first basic structure according to the present invention.

FIG. 2 is a cross-sectional view schematically showing a structure of an electron emission element of the present embodiment exemplifying the structure in FIG. 1B, in which, in particular, the vicinity of the electron emission portion 1 is enlarged. Furthermore, FIG. 2 schematically shows an idea of electron emission in the electron emission element of the present embodiment (first basic structure according to the present invention).

More specifically, due to the function of a transverse electric field between the electrodes 2 and 3 generated by the application of a voltage across the electrodes 2 and 3, electrons are emitted from the negative electrode 2 to an adjacent electron emission portion 1. A voltage between the electrodes 2 and 3 necessarily generates an electric field between the adjacent electron emission portions 1. Therefore, electrons which have reached an electron emission portion 1 are emitted again to another adjacent electron emission portion 1. With such repetition of an emission operation, electrons gradually move from the negative electrode 2 to the positive electrode 3. In the course of this, a part of emission electrons are output in a direction away from the surface of the insulating substrate 4.

When each electron emission portion 1 is made of particles or an aggregate of particles, the electron emission portions 1 can be dispersed at a high density, which is preferable. Furthermore, as a constituent material for the electron emission portion 1, a material with a small work function, which is likely to emit electrons, is preferably used. For example, a material exhibiting a negative electron affinity such as diamond is used.

If a level of a bias voltage applied across the electrodes 2 and 3, and/or the extraction electrode 5 is controlled, an electric field with an appropriate level can be applied between the adjacent electron emission portions 1; as a result, the number of electrons to be emitted can be controlled. Furthermore, acceleration energy and orbit of electrons moving between the electron emission portions 1 can be controlled. A value of a bias voltage applied across the electrodes 2 and 3 depends upon the interval between the electrodes 2 and 3 and the density of the electron emission portions 1; however, it is preferably about 200 volts or less.

The electron emission portions 1 are present independently at a very small interval. In order to efficiently conduct electron emission (i.e., movement to an adjacent electron emission portion 1), the interval between the adjacent electron emission portions 1 is preferably as small as possible. It is preferable that the interval is possibly less than about 0.1 $\mu$m or less. The interval between the actually obtained electron emission portions 1 depends upon the size and density of particles forming the electron emission portions 1. However, for example, in the case where particles with an average particle diameter of about 0.01 $\mu$m are used, a particle density (dispersion density of the electron emission portions 1) is preferably prescribed to be about $1\times10^{10}/cm^2$ or more, in order to obtain the above-mentioned preferable interval.

Even if part of the electron emission portions 1 is present on the surface of the electrode 2 or 3, the effect of the present invention is not affected.

Figure 3A:
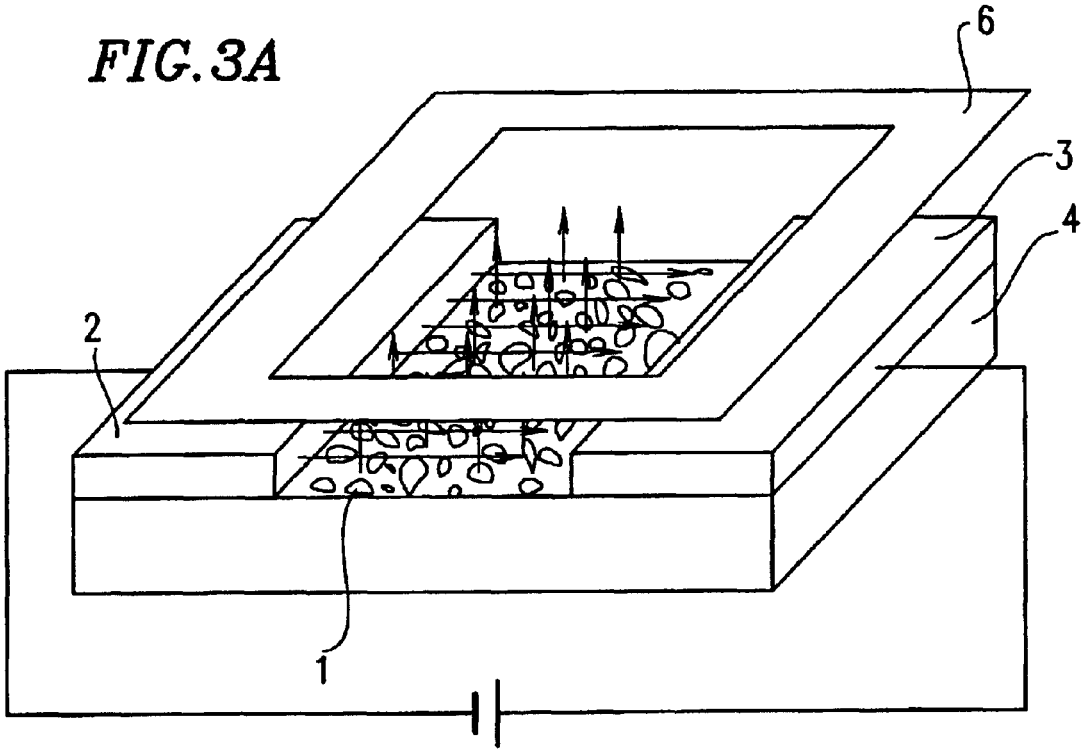
FIG. 3A is a perspective view schematically showing still another structure of an electron emission element having a first basic structure according to the present invention.
Figure 3B:
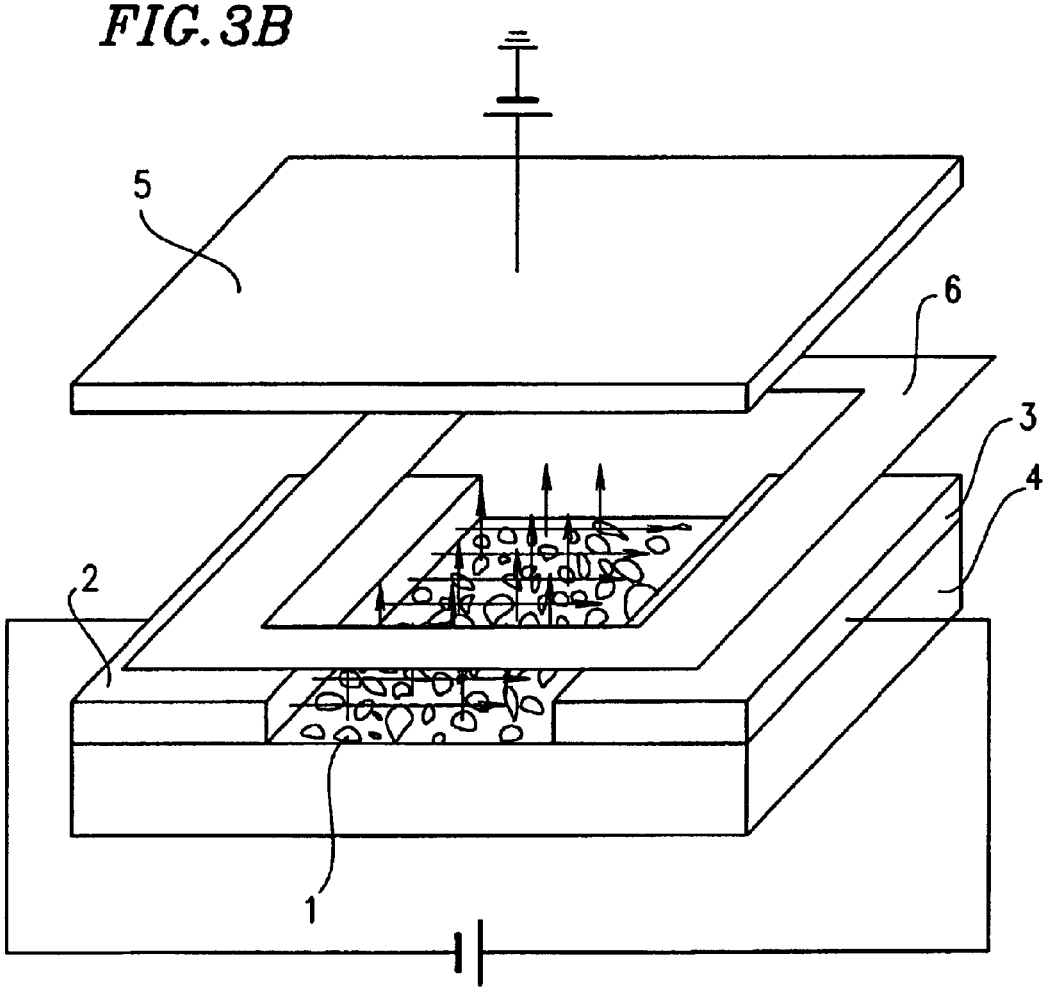
FIG. 3B is a perspective view schematically showing still another structure of an electron emission element having a first basic structure according to the present invention.

The structure (combination) of electrodes is not limited to those shown in FIGS. 1A and 1B. For example, if a frame-shaped electrode (focus electrode) 6 as shown in FIGS. 3A and 3B is disposed, and an appropriate voltage is applied thereto, focusing of an output electron beam can be adjusted.

Figure 4A:
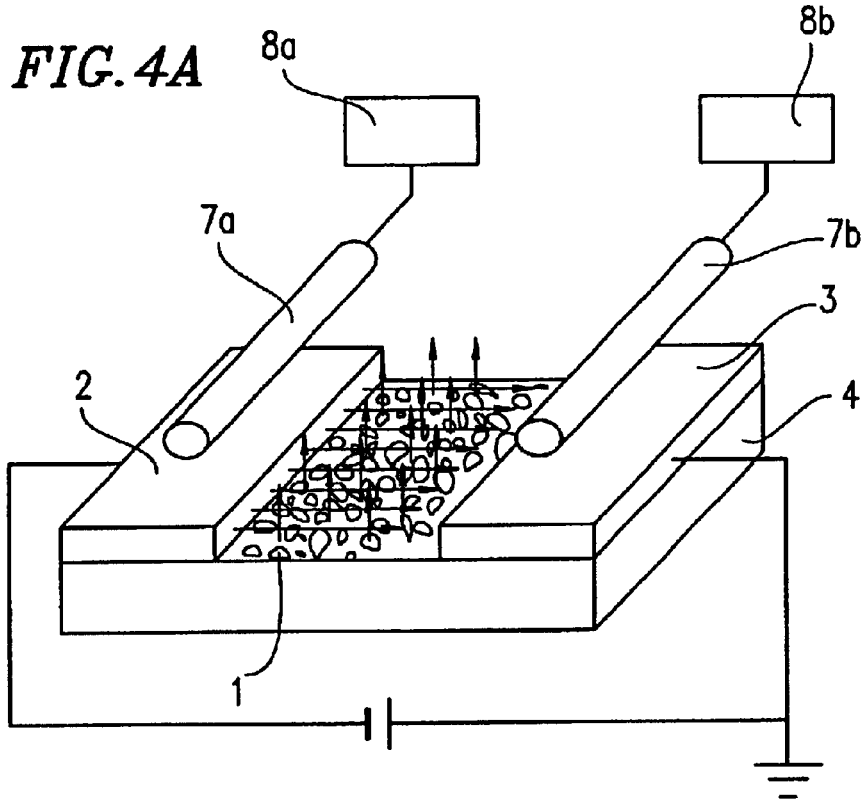
FIG. 4A is a perspective view schematically showing still another structure of an electron emission element having a first basic structure according to the present invention.
Figure 4B:
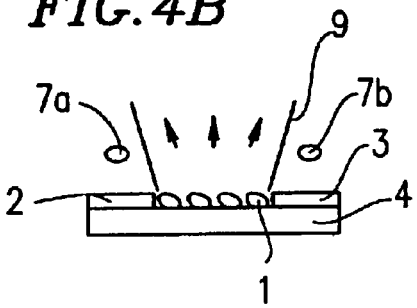
FIGS. 4B through 4E schematically show states where an electron beam is emitted from the electron emission element shown in FIG. 4A.
Figure 4D:
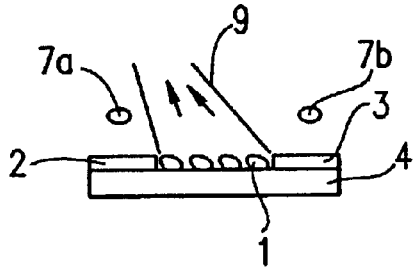
Figure 4C:
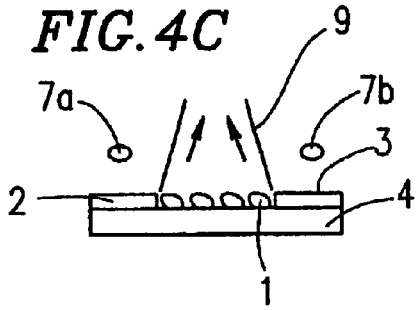
Figure 4E:
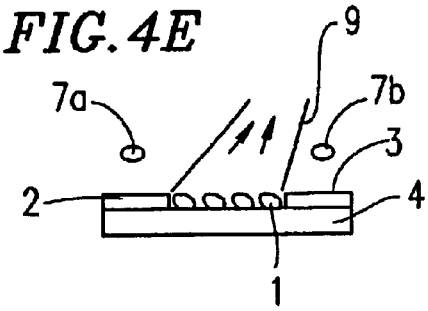

Furthermore, it may also be possible that bar-shaped electrodes 7*a* and 7*b* as shown in FIG. 4A are disposed so as to face electrodes 2 and 3, and the electrodes 7*a* and 7*b* are connected to power sources 8*a* and 8*b*, respectively. In this structure, if a negative voltage is independently applied to the electrodes 7*a* and 7*b*, a direction of an output electron beam can be controlled or adjusted. For example, as shown in FIG. 4B, if a negative voltage is not applied to either of the electrodes 7*a* and 7*b*, an electron beam 9 is emitted so as to gradually spread. On the other hand, as shown in FIG. 4C, if a negative voltage is applied to both of the electrodes 7*a* and 7*b*, the electron beam 9 is emitted so as to gradually converge. Furthermore, an example shown in FIG. 4D is the case where a negative voltage is applied only to the electrode 7*b* without being applied to the electrode 7*a*. On the other hand, an example shown in FIG. 4E is the case where a negative voltage is applied only to the electrode 7*a* without being applied to the electrode 7*b*. In these cases, the electron beam 9 converges, tilting toward the side where there is no electrode to which a negative voltage is not applied among the electrodes 7*a* and 7*b*.

Alternatively, an electron beam can be controlled in a similar manner to the above, even by applying a positive voltage to the electrodes 7*a* and 7*b*. In this case, a direction of an electron beam and converged state thereof are controlled in such a manner as to be close to the electrode 7*a* or/and 7*b* to which a positive voltage is applied.

In FIGS. 4A through 4E, the extraction electrode 5, focus adjusting electrode (focus electrode) 6 described above are not shown; however, one or both of the electrodes 5 and 6 may be provided.

Figure 5A:
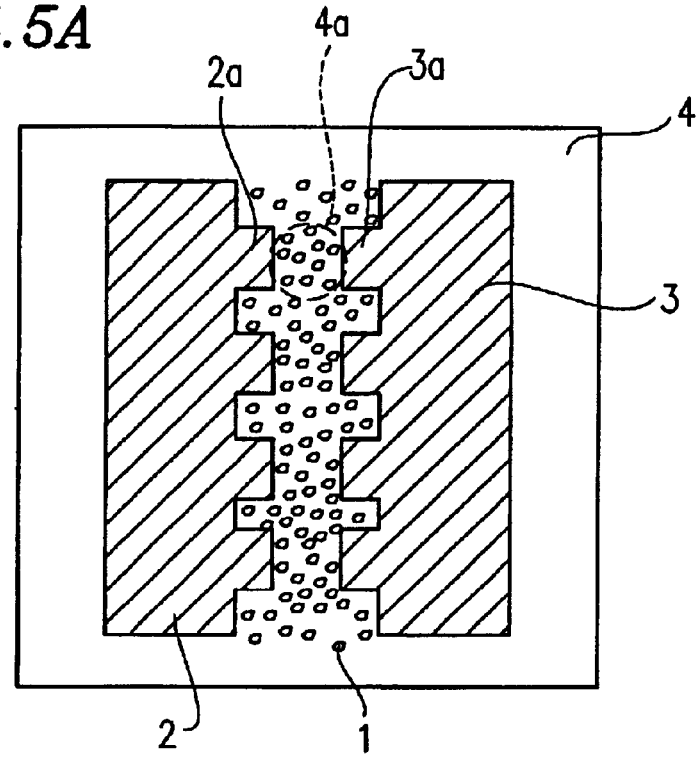
FIG. 5A is a plan view schematically showing another shape of an electrode in an electron emission element having a first basic structure according to the present invention.
Figure 5B:
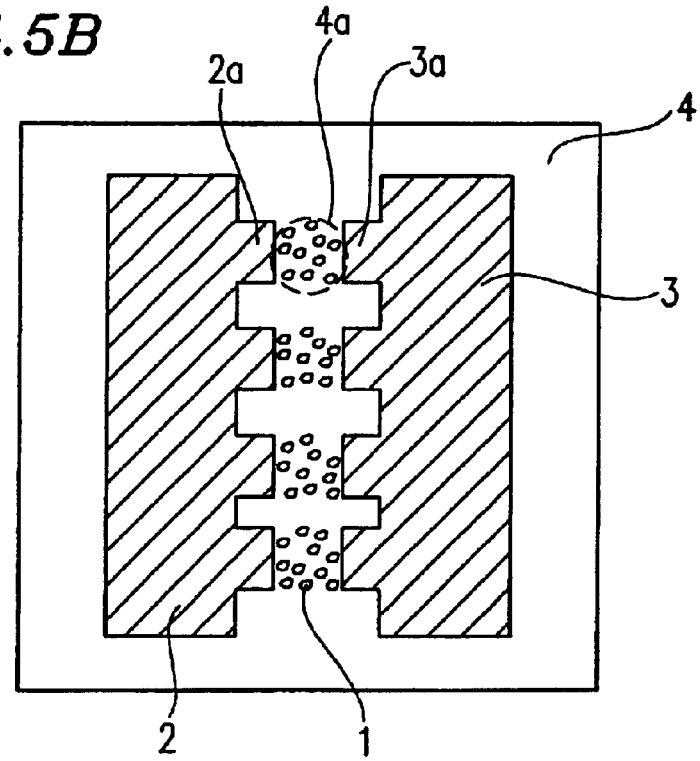
FIG. 5B is a plan view schematically showing still another shape of an electrode in an electron emission element having a first basic structure according to the present invention.

Furthermore, in the examples described above, surfaces of the electrodes 2 and 3 opposed to each other are linearly formed. However, in an example shown in FIG. 5A, a plurality of convex portions 2*a* and 3*a* corresponding to each other are formed at substantially an equal interval on surfaces of the electrodes 2 and 3 opposed to each other, respectively. Alternatively, as shown in FIG. 5B, the electron emission portions 1 may be dispersed only in regions 4*a* interposed between the convex portions 2*a* and 3*a*.

When a plurality of convex portions 2*a* and 3*a* corresponding to each other are provided, an electric field is likely to concentrate in the vicinity of the convex portions 2*a* and 3*a*. However, an electric field does not excessively concentrate on a part of the opposed surfaces of the electrodes 2 and 3, and is equally dispersed over the entire surfaces. As a result, an electron emission state is rendered uniform in the electron emission element. If such an electron emission element is used, for example, in an image display apparatus, nonuniform brightness of an image to be displayed can be reduced by the uniformed electron emission state, and an image of high quality can be displayed.

Figure 6A:
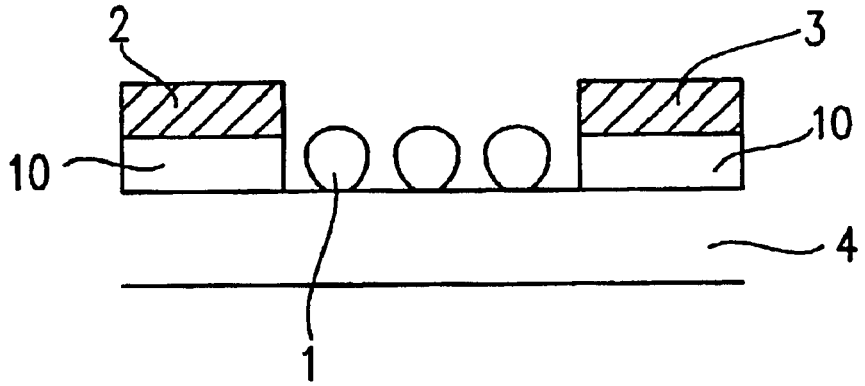
FIGS. 6A through 6C are cross-sectional views, which respectively schematically show other shapes of an electrode in an electron emission element having a first basic structure according to the present invention.
Figure 6B:
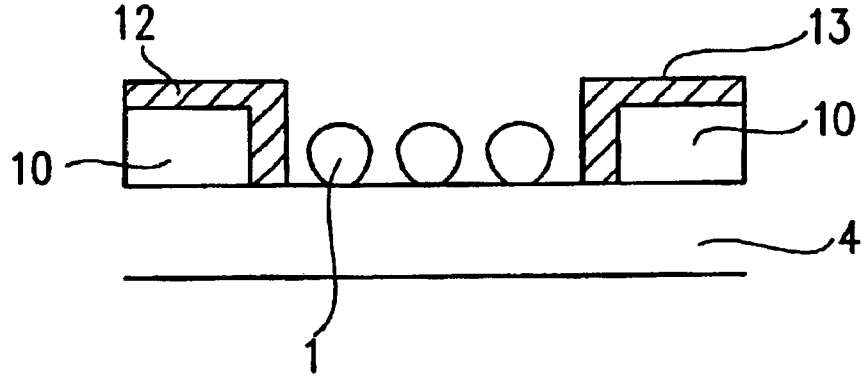
Figure 6C:
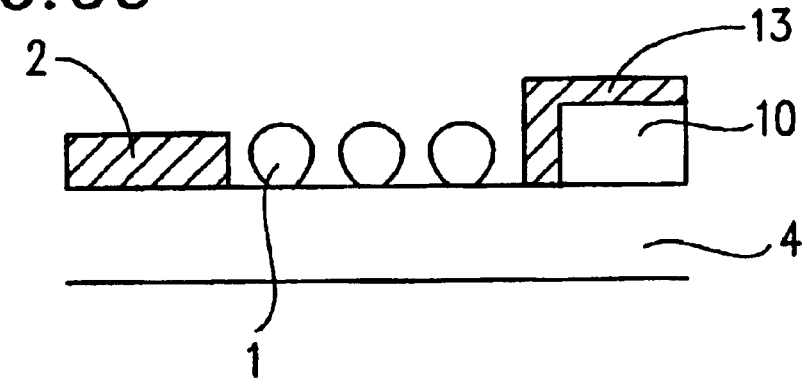

In the examples described above, the electrodes 2 and 3 are disposed directly on the surface of the insulating substrate 4. However, the electrodes 2 and 3 may be disposed via an insulating layer 10, as shown in FIG. 6A. Alternatively, as shown in FIG. 6B, it may be possible that a pair of insulating layers 10 are disposed on the insulating substrate 4 at a predetermined interval, and the electrodes 12 and 13 are formed on the upper and opposed side surfaces thereof. Furthermore, in this case, as shown in FIG. 6C, one electrode (electrode 2 in an example shown in the figure) may be disposed on the insulating substrate 4 as in the above-mentioned examples, and the other may be the electrode 13 formed on the upper and side surfaces of the insulating layer 10.

As described above, an electrode structure (electrodes 2 and 3, and additional electrode 5 or 6 provided for the other purpose) and an arrangement of the electron emission portion in the structure of the present embodiment may be variously modified.

Because of the above-mentioned structure, electron emission is realized. However, in order to obtain more efficient electron emission characteristics, it is important to select a preferable structure and material for the electron emission portion 1.

According to the present invention, the dispersed electron emission portions 1 are preferably made of diamond or a material mainly containing diamond. Diamond is a semiconductor material having a wide forbidden bandgap (5.5 eV), which has properties very suitable for an electron emission material, such as high hardness, a high heat conductivity, outstanding resistance to friction, and chemical inactivity. Thus, as described above, if diamond or a material mainly containing diamond is used, an electron emission portion with high stability can be constructed.

Furthermore, it is preferable to include a structure in which atoms on the outermost surface of diamond or a material mainly containing diamond included in the electron emission portion 1 are terminated by binding to hydrogen atoms. A hydrogen-terminated diamond surface is in a negative electron affinity state, so that electrons are likely to be output, and a diamond surface further suitable for electron emission can be maintained. An amount of binding hydrogen atoms for obtaining such a stable surface is preferably about $1\times10^{15}/cm^2$ or more, and more preferably about $2\times10^{15}/cm^2$ or more, where substantially all the carbon atoms on the outermost surface bind to hydrogen atoms.

In a certain case, a surface layer of diamond or a material mainly containing diamond is rendered a layer having crystal defects. This enables the amount of electrons to be transmitted to the electron emission portion to be increased. In this case, the crystal defect density is preferably about $1\times10^{13}/cm^3$ or more, and more preferably about $1\times10^{15}/cm^3$ or more.

Diamond particles included in the electron emission portion 1 may contain non-diamond component (e.g., graphite or amorphous carbon). In this case, the non-diamond component to be contained is preferably less than about 10% by volume.

A method for producing diamond particles included in the electron emission portion 1 is not particularly limited to a special process. However, considering introduction of defects and surface treatment, it is effective to produce diamond particles by further crushing a diamond film formed by a vapor-phase synthesis method.

The electron emission portion 1 is preferably made of a particle or an aggregate of particles. Because of this, the electron emission portions 1 can be easily dispersed in any region at an arbitrary density. In this case, in order to enable a micro-element structure to be formed and a number of electron emission portions 1 to be disposed, an average particle diameter of each particle is prescribed to be about 10 $\mu$m or less, and more preferably about 1 $\mu$m or less. Furthermore, in order to achieve enhancement of an operation efficiency of an electron emission element to be formed and stable operation, a distribution density of the electron emission portions (particle or an aggregate of particles) 1 is preferably prescribed to be about $1\times10^8/cm^2$ or more. Furthermore, in order to obtain a larger electron emission current, the distribution density is further increased (preferably, about $1\times10^{10}/cm^2$ or more).

Embodiment 2

Figure 7A:
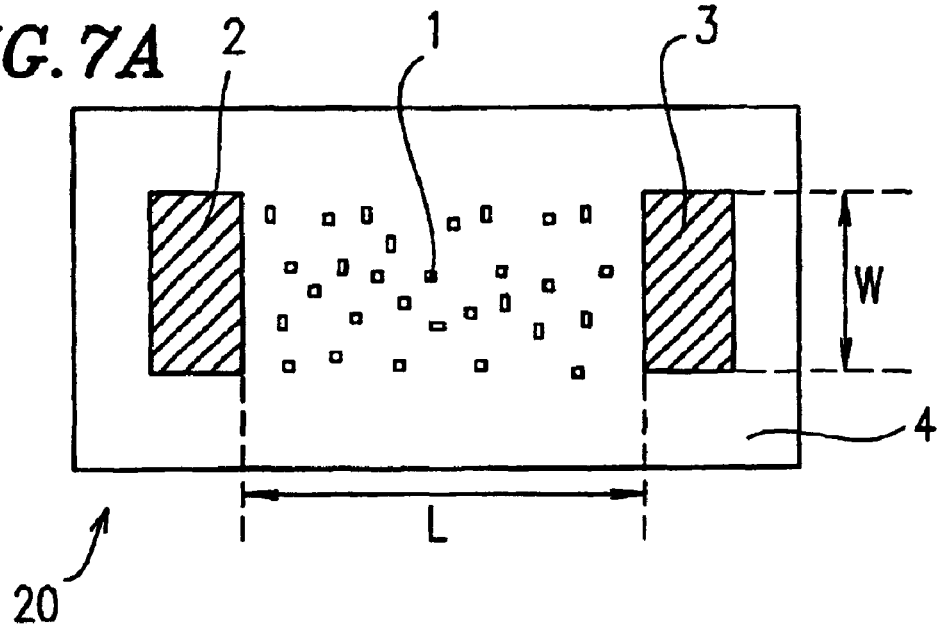
FIGS. 7A and 7B are a plan view and a cross-sectional view schematically showing a structure of an electron emission element having a first basic structure according to the present invention.
Figure 7B:
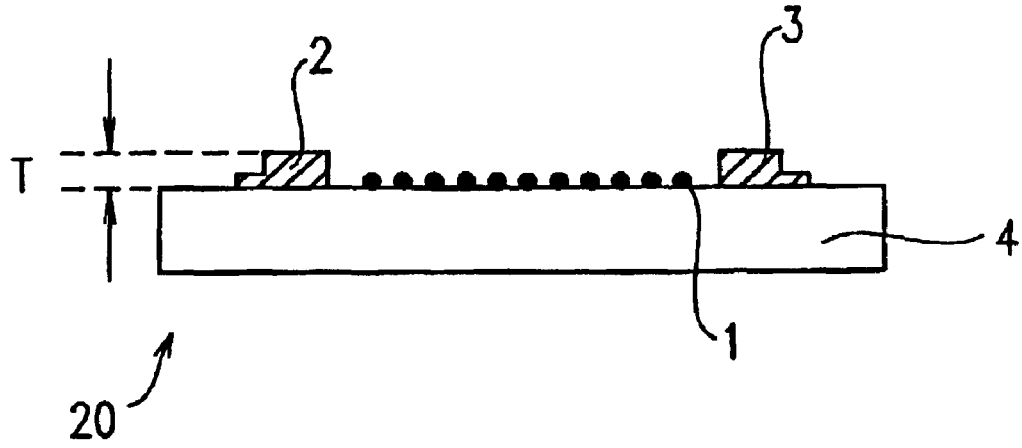

Next, as the second embodiment of the present invention, a method for producing the electron emission element having a first basic structure according to the present invention described in the first embodiment will be described with reference to FIGS. 7A and 7B. FIGS. 7A and 7B are a plan view and a side view schematically showing a structure of an electron emission element 20 in an embodiment in accordance with the first basic structure according to the present invention.

More specifically, a pair of electrodes 2 and 3 (for example, made of Au) are formed at a predetermined interval (typically, for example, L=about 0.1 mm) on an insulating substrate 4 (e.g., a glass substrate 4), for example, by vapor deposition. The electrodes 2 and 3 have a thickness T=about 0.3 $\mu$m, and a width W=about 0.5 mm, for example. A constituent material for the substrate 4 is not limited to glass, as long as it is an insulating material. Furthermore, a constituent material for the electrodes 2 and 3 is not limited to Au.

Next, the substrate 4 on which the above-mentioned electrodes 2 and 3 are formed is placed in a solution in which diamond particles (average particle diameter: about 0.01 $\mu$m, produced by Tomei Diamond) are dispersed, and an ultrasonic vibration is applied to the solution for about 15 minutes. In the present embodiment, the solution is obtained by dispersing about 2 g of diamond particles in about 1 liter of pure water, adding about 2 liters of ethanol to the mixture, and adding several drops of hydrofluoric acid (pH=about 3). More specifically, the concentration of diamond particles in the solution is about 0.67 g per liter of solution (number of particles: about $4\times10^{17}$ per liter of solution).

Subsequently, after finishing ultrasonic vibration treatment, the substrate 4 is taken out of the solution, and washed with pure water for about 10 minutes. Thereafter, the substrate 4 is dried by blow of nitrogen gas and infrared heating. Thus, the electron emission element 20 of the present embodiment can be formed.

When the surface of the glass substrate 4 treated by the above-mentioned process is observed with a scanning electron microscope, it is understood that diamond particles and aggregates of diamond particles 1 with a particle diameter of about 0.01 $\mu$m to about 0.10 $\mu$m are uniformly distributed between the Au electrodes 2 and 3 at a distribution density of about $5\times10^{10}/cm^2$.

Next, results of an experiment for confirming a state where electrons are emitted from the electron emission element 20 formed as described above will be described. The experiment was conducted by using an evaluation apparatus shown in FIG. 8.

More specifically, the electron emission element 20 was placed in a vacuum container 22 with a vacuum degree of about $4\times10^{-9}$ Torr, and a bias voltage up to about 200 volts was applied across Au electrodes 2 and 3 by a power source 26. Furthermore, a positive electric potential of about 2 kV was applied to an extraction electrode 21 opposed to the substrate 4 at an interval of about 1 mm by the power source 25. As a result, it was confirmed that electrons were emitted from a surface where diamond particles 1 were distributed to the extraction electrode 21. More specifically, according to measurement using electric current meters 23 and 24, it was observed that in the case where an applied voltage across the Au electrodes 2 and 3 was about 100 volts, an electric current of about 1 mA flowed between the Au electrodes 2 and 3, and an electric current (emission current) of about 2 $\mu$A was output from the extraction electrode 22.

The experiment was conducted by varying an interval between the Au electrodes 2 and 3 and a dispersion density of the diamond particles 1. It was confirmed that electrons were emitted when a ratio (emission efficiency) between an electric current flowing between the Au electrodes 2 and 3 and an emission current was in a range of about 0.01% to about 0.5%.

For comparison, by using diamond particles having different particle diameters, a dispersion density of diamond particles obtained in each case and an applied voltage across the electrodes 2 and 3 were measured. Table 1 shows the results.

TABLE 1

| Sample No. | Particle diameter ($\mu$m) | Density (pieces/cm$^2$) | Voltage between electrodes (V) |
|---|---|---|---|
| 1 | 0.01 | $2 \times 10^{11}$ | 50 |
| 2 | 0.05 | $4 \times 10^{10}$ | 70 |
| 3 | 0.10 | $1 \times 10^{10}$ | 150 |
| 4 | 0.15 | $7 \times 10^{8}$ | 200 |
| 5 | 0.20 | $2 \times 10^{7}$ | — |

Thus, as the particle diameter of diamond particles is increased, the dispersion density of particles is decreased. In this case the interval between particles is increased, so that a voltage to be applied across the electrodes is increased in order to realize electron emission, which degrades an emission efficiency. In particular, when the particle diameter becomes about 0.20 $\mu$m as in Sample No. 5, even through a voltage of about 200 volts was applied across the electrodes, emission of electrons was not confirmed.

Accordingly, in order to allow electrons to be emitted with good efficiency according to the present invention, it is required that a density at which electron emission portions (diamond particles) 1 are dispersively placed on the surface of the substrate 4 is about $1\times10^{10}$/cm$^2$ or more. In order to realize this, it is required that the density of diamond particles dispersed in a solution in which the substrate 4 is placed and to which an ultrasonic wave is applied is prescribed to be more than about $1\times10^{15}$/cm$^2$ per liter. However, if the density of the diamond particles in the solution becomes more than about $1\times10^{20}$ per liter, dispersibility of the diamond particles 1 on the surface of the substrate 4 becomes poor, which makes it difficult to set the electron emission portions (diamond particles) 1 in such a manner that they do not come into contact with each other on the surface of the substrate 4.

Furthermore, the density at which the diamond particles 1 are dispersively placed can be enhanced depending upon the conditions of ultrasonic vibration treatment.

More specifically, an experiment was conducted using diamond particles with a particle diameter of about 0.01 $\mu$m, by changing only the condition of ultrasonic vibration treatment (i.e., changing an applied electric power to about 300 W and a treatment time to about 30 minutes) under the above-mentioned process condition. A surface state of the resultant substrate was observed with a scanning electron microscope, confirming that aggregates of diamond particles were hardly found, and only the diamond particles were dispersed uniformly with a higher distribution density. It is conceivable that this is caused by an increase in an applied electric power and a treatment time of the ultrasonic treatment condition. More specifically, the distribution density of the diamond particles was about $1\times10^{11}$/cm$^2$. However, it is not necessarily non-preferable that aggregates of particles are present.

Furthermore, when fluorine atoms are contained in a solution in which diamond particles are dispersed, wettability between the substrate and the solution is enhanced, and the distribution density of the diamond particles on the resultant substrate is enhanced. For example, in the present embodiment, hydrofluoric acid is dropped onto the solution as described above. However, the present invention is not limited thereto. Even the use of ammonium fluoride has the similar effect.

The solution in which diamond particles are dispersed should contain mainly water or alcohol. Furthermore, the pH value of the solution is preferably about 7 or less. When the pH value becomes larger than about 7, the distribution density of the diamond particles on the resultant substrate is remarkably decreased. The phenomenon of a decrease in the dispersion density of the diamond particles related to a setting range of the pH value is not limited to the ultrasonic vibration treatment method in the present embodiment. This phenomenon was also confirmed according to another treatment method using a solution in which diamond particles were dispersed.

As described above, according to the production method of the present invention, diamond which is very suitable as a constituent material for the electron emission portions can be easily dispersed on the surface of a predetermined substrate in the shape of micro-particles or aggregates thereof which are to be electron emission portions with good reproducibility at an arbitrary density. Instead of subjecting a substrate the ultrasonic treatment in the solution in which diamond particles are dispersed as in the present embodiment, by applying a voltage to a substrate in the solution or coating the surface of a substrate with the solution, an electron emission element exhibiting the similar effect can be obtained.

Even when a material (e.g., particle-shaped boron nitride (BN) and the like) other than diamond, which is likely to emit electrons, is used for an electron emission portion, substantially the same effect as the above can be obtained.

Embodiment 3

Next, as the third embodiment, a method for producing an electron emission element according to the present invention will be described, which includes a step of conducting a predetermined surface treatment with respect to an electron emission portion made of a diamond particle or an aggregate of diamond particles.

In the present embodiment, in the process similar to that in Embodiment 2 (an electron emission element to be formed and a shape and a size of each component are the same as those in Embodiment 2), diamond particles are uniformly distributed between two electrodes on a glass substrate. Thereafter, in the present embodiment, as a method for controlling a surface structure of the diamond particles, the diamond particles are exposed to plasma obtained by discharge decomposition of hydrogen gas. More specifically, for example, the surfaces of the diamond particles can be exposed to hydrogen plasma by utilizing microwave plasma discharge of hydrogen gas. However, means for forming hydrogen plasma is not limited thereto. The condition of generating plasma is that a hydrogen pressure is about 20 Torr, a microwave input power is about 150 W, a temperature of a substrate exposed to plasma is about 500° C., and a time for exposure to hydrogen plasma is about 30 seconds.

As a result of the above-mentioned treatment, it was confirmed that carbon atoms on the outermost surface in a region exposed to hydrogen plasma bound to hydrogen atoms. At this time, the amount of hydrogen atoms binding to carbon atoms was about $1\times10^{15}/cm^2$.

As described above, it is said that when carbon atoms on the outermost surface of diamond bind to hydrogen atoms, a negative electron affinity will be exhibited. As a result of observation by irradiation with ultraviolet light, it was confirmed that even diamond particles obtained by the treatment of the present embodiment as described above exhibited a negative electron affinity. Thus, in the present embodiment, an electron emission element can be implemented, which is provided with electron emission portions made of diamond particles or aggregates of diamond particles having a negative electron affinity (NEA characteristics).

Even in the case where an exposure time of the diamond particles to discharge plasma of hydrogen gas is changed from the above-mentioned value, in the case where hydrogen gas is diluted to about 10% with argon or nitrogen, or in the case where the diamond particles are exposed to hydrogen plasma formed by another method, as long as the amount of hydrogen atoms binding to carbon atoms is about $1\times10^{15}/cm^2$, the results substantially similar to those in the above can be obtained. However, when the amount of hydrogen atoms binding to carbon atoms is decreased from the above-mentioned value, a state of a negative electron affinity becomes insufficient, which is not preferable.

In order to prescribe the amount of hydrogen atoms binding to carbon atoms to be about $1\times10^{15}/cm^2$ or more, it is desirable that the temperature of the diamond particles (or a substrate on which the diamond particles are distributed) during exposure to hydrogen plasma is kept at about 300° C. or more.

Figure 8:
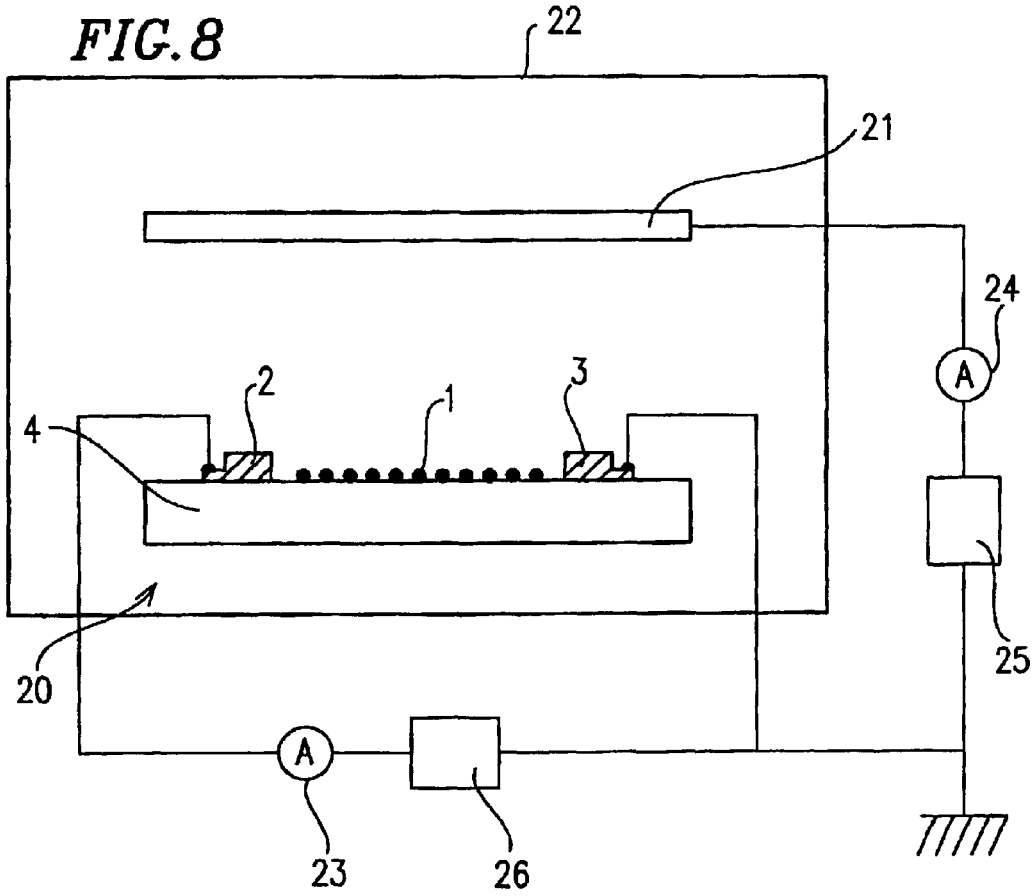
FIG. 8 is a view schematically showing a structure of an evaluation apparatus of an electron emission element having a first basic structure according to the present invention.

The electron emission element formed as described above was evaluated by using the apparatus shown in FIG. 8 described above.

More specifically, the electron emission element of the present embodiment was placed in a vacuum container with a vacuum degree of about $4\times10^{-9}$ Torr, and a bias voltage up to about 150 volts was applied across Au electrodes. Furthermore, a positive electric potential of about 2 kV was applied to an extraction electrode opposed to the substrate at an interval of about 1 mm. As a result, it was confirmed that electrons were emitted from a surface where diamond particles were distributed to the extraction electrode. More specifically, it was observed that in the case where an applied voltage across the Au electrodes was about 100 volts, an electric current of about 1.2 mA flowed between the Au electrodes, and an electric current (emission current) of about 26 $\mu$A flowed from the extraction electrode.

The experiment was conducted by varying an interval between the Au electrodes and a dispersion density of the diamond particles. It was confirmed that electrons were emitted when a ratio (emission efficiency) between an electric current flowing between the Au electrodes and an emission current was in a range of about 0.5% to about 10%. This shows that electrons are emitted more efficiently than in the case of the second embodiment. The reason for this is considered that electrons are emitted more easily by treatment of the surface of electron emission portions with hydrogen.

In the above description, the diamond particles are exposed to hydrogen plasma after being distributed. However, the present invention is not limited thereto. Even in the case where the diamond particles are treated with hydrogen plasma, followed by being dispersed, similar results can be obtained.

Embodiment 4

Next, as a method for controlling a surface state of an electron emission portion made of a diamond particle or an aggregate of diamond particles in the fourth embodiment, a method for producing an electron emission element according to the present invention will be described, which includes a step of forming p-type defects on the surface of the diamond particles.

In the present embodiment, in the process similar to that in Embodiment 2 (an electron emission element to be formed and a shape and a size of each component are the same as those in Embodiment 2), diamond particles are uniformly distributed between two electrodes on a glass substrate. Thereafter, in the present embodiment, p-type diamond particles are grown by a vapor-phase synthesis method. The vapor-phase synthesis method of diamond is not particularly limited. In general, material gas is used, which is obtained by diluting a carbon source (such as hydrocarbon gas (e.g., methane, ethane, ethylene, acetylene, etc.), an organic compound (e.g., alcohol, acetone, etc.), or carbon monoxide) with hydrogen gas, and energy is given to the material gas so as to decompose it. In this case, oxygen, water, or the like may be appropriately added to the material gas.

In the embodiment described below, p-type diamond particles are grown by a microwave plasma CVD method which is a kind of a vapor-phase synthesis method. This method is conducted by applying a microwave to material gas so as to form plasma, thereby forming diamond. As a specific condition, carbon monoxide gas diluted to about 1 vol % to about 10 vol % with hydrogen, and in order to obtain p-type particles, diborane gas is added to the material gas. A reaction temperature and a pressure are about 800° C. to about 900° C. and about 25 Torr to about 40 Torr, respectively.

Alternatively, in place of a microwave plasma CVD method, another vapor-phase synthesis process such as a hot filament method can be used.

The thickness of a p-type diamond growth layer thus formed is typically about 0.1 $\mu$m. Furthermore, it is confirmed by secondary ion mass spectrometry that the resultant p-type film contains about $1\times10^{18}/cm^3$ boron atoms, and its resistivity is about $1\times10^2$ $\Omega\cdot$cm or less.

Furthermore, hydrogen binds to the outermost surface of diamond obtained by the above-mentioned vapor-phase synthesis process. As a result of evaluating an electron affinity state of p-type diamond by irradiation with ultraviolet light, a negative electron affinity state was confirmed.

The electron emission element formed as described above was evaluated by using the apparatus shown in FIG. 8 described above.

More specifically, the electron emission element of the present embodiment was placed in a vacuum container with a vacuum degree of about $4\times10^{-9}$ Torr, and a bias voltage up to about 150 volts was applied across Au electrodes. Furthermore, a positive electric potential of about 2 kV was applied to an extraction electrode opposed to the substrate at an interval of about 1 mm. As a result, it was confirmed that electrons were emitted from a surface where diamond particles were distributed to the extraction electrode. More specifically, it was observed that in the case where an applied voltage across the Au electrodes was about 80 volts, an electric current of about 1.1 mA flowed between the Au electrodes, and an electric current (emission current) of about 9 $\mu$A flowed from the extraction electrode.

The experiment was further conducted by varying an interval between the Au electrodes and a dispersion density of the diamond particles. It was confirmed that electrons were emitted when a ratio (emission efficiency) between an electric current flowing between the Au electrodes and an emission current was in a range of about 0.5% to about 10%. This shows that electrons are emitted more efficiently than in the case of the second embodiment.

Embodiment 5

Next, as a method for controlling a surface state of an electron emission portion made of a diamond particle or an aggregate of diamond particles in the fifth embodiment, a method for producing an electron emission element according to the present invention will be described, which includes a step of forming defects on the surface of the diamond particles by a method different from that in Embodiment 4.

In the present embodiment, in the process similar to that in Embodiment 2 (an electron emission element to be formed and a shape and a size of each component are the same as those in Embodiment 2), diamond particles are uniformly distributed between two electrodes on a glass substrate. Thereafter, in the present embodiment, boron atoms are implanted onto the surface of the diamond particles by an ion implantation method, and the resultant particles are annealed in a vacuum at a temperature of about 800° C. Thereafter, the particles are exposed to hydrogen plasma formed by microwave discharge described in the third embodiment, whereby diamond particles with a negative electron affinity are obtained.

The acceleration voltage at a time of ion implantation is about 10 kV, and the implantation density of ions is about $1\times10^{16}/cm^3$. Furthermore, the resistivity of a surface film obtained by the above-mentioned treatment is about $3\times10^2$ $\Omega\cdot$cm or less.

The atoms to be implanted according to the present invention are not limited to boron. However, atoms (e.g., iron, nickel, cobalt, etc.) having a catalytic function are not preferable for carbon atoms.

The electron emission element formed as described above was evaluated by using the apparatus shown in FIG. 8 described above.

More specifically, the electron emission element of the present embodiment was placed in a vacuum container with a vacuum degree of about $2\times10^{-8}$ Torr, and a bias voltage up to about 100 volts was applied across Au electrodes. Furthermore, a positive electric potential of about 2 kV was applied to an extraction electrode opposed to the substrate at an interval of about 1 mm. As a result, it was confirmed that electrons were emitted from a surface where diamond particles were distributed to the extraction electrode. More specifically, it was observed that in the case where an applied voltage across the Au electrodes was about 45 volts, an electric current of about 0.7 mA flowed between the Au electrodes, and an electric current (emission current) of about 2 $\mu$A flowed from the extraction electrode.

The experiment was further conducted by varying an interval between the Au electrodes and a dispersion density of the diamond particles. It was confirmed that electrons were emitted when a ratio (emission efficiency) between an electric current flowing between the Au electrodes and an emission current was in a range of about 5% to about 8%. This shows that electrons are emitted more efficiently than in the case of the second embodiment.

In the above-mentioned description, after diamond particles are distributed, ion implantation treatment is conducted. However, the present invention is not limited thereto. Even in the case where the diamond particles are first subjected to ion implantation, followed by being dispersed, similar results are confirmed.

Embodiment 6

Next, as the sixth embodiment, a method for producing an electron emission element according to the present invention will be described, which includes a step of conducting another predetermined surface treatment to an electron emission portion made of a diamond particle or an aggregate of diamond particles.

In the present embodiment, in the process similar to that in Embodiment 2 (an electron emission element to be formed and a shape and a size of each component are the same as those in Embodiment 2), diamond particles are uniformly distributed between two electrodes on a glass substrate. Thereafter, in the present embodiment, as a method for controlling a surface structure of the diamond particles, the surfaces of the diamond particles are exposed to high-temperature hydrogen gas atmosphere. More specifically, a substrate on which diamond particles are distributed is placed in a cylindrical container through which hydrogen gas flows, and is heated at about 600° C. for about 30 minutes.

As a result of the above-mentioned treatment, it was confirmed that carbon atoms on the outermost surface in a region exposed to hydrogen plasma bound to the hydrogen atoms. At this time, the amount of hydrogen atoms binding to carbon atoms was about $1\times10^{16}/cm^2$. Furthermore, as a result of observation by irradiation with ultraviolet light, it was confirmed that the electron affinity on the surfaces of the diamond particles changed from a positive state to a negative state. It was confirmed that it is possible to control the electron affinity on the surfaces of the diamond particles which are to be electron emission portions by using this process.

Even in the case where hydrogen gas which flows through the container is diluted to about 10% with argon or nitrogen, in the case where the heating temperature is varied in a range of about 400° C. to about 900° C., or in the case where the heating time is changed, as long as the amount of hydrogen atoms binding to carbon atoms is about $1\times10^{15}/cm^2$, the results substantially similar to those in the above can be obtained. However, when the amount of hydrogen atoms binding to carbon atoms is decreased from the above-mentioned value, a state of a negative electron affinity becomes insufficient, which is not preferable.

The electron emission element formed as described above was evaluated by using the apparatus shown in FIG. 8 described above.

More specifically, the electron emission element of the present embodiment was placed in a vacuum container with a vacuum degree of about $2\times10^{-7}$ Torr, and a bias voltage up to about 150 volts was applied across Au electrodes. Furthermore, a positive electric potential of about 2 kV was applied to an extraction electrode opposed to the substrate at an interval of about 1 mm. As a result, it was confirmed that electrons were emitted from a surface where diamond particles were distributed to the extraction electrode. More specifically, it was observed that in the case where an applied voltage across the Au electrodes was about 100 volts, an electric current of about 1.0 mA flowed between the Au electrodes, and an electric current (emission current) of about 20 $\mu$A flowed from the extraction electrode.

The experiment was further conducted by varying an interval between the Au electrodes and a dispersion density of the diamond particles. It was confirmed that electrons were emitted when a ratio (emission efficiency) between an electric current flowing between the Au electrodes and an emission current was in a range of about 0.5% to about 10%. This shows that electrons are emitted more efficiently than in the case of the second embodiment. The reason for this is considered that electrons are emitted more easily by treatment of the surface of electron emission portions with hydrogen.

Embodiment 7

Next, as the seventh embodiment, the case where the quality of diamond particles distributed and forming electron emission portions is varied will be described below.

In the present embodiment, in the process similar to that in Embodiment 2 (an electron emission element to be formed and a shape and a size of each component are the same as those in Embodiment 2), diamond particles are uniformly distributed between two electrodes on a glass substrate. In the present embodiment, the diamond particles are produced by crushing a diamond film (synthesis condition: hydrogen/Ar ratio=about 0.25, methane/hydrogen ratio=about 0.20, substrate temperature=about 960° C., synthesis speed=about 6 $\mu$m/min.) formed by a DC plasma jet CVD method. The particle diameter of the diamond particles thus obtained is about 100 $\mu$m, and the distribution density of the diamond particles (electron emission portions) in an electron emission element completed by using this is about 200/cm$^2$.

The electron emission element formed as described above was evaluated by using the apparatus shown in FIG. 8 described above.

More specifically, the electron emission element of the present embodiment was placed in a vacuum container with a vacuum degree of about $5\times10^{-7}$ Torr, and a bias voltage up to about 250 volts was applied across Au electrodes. Furthermore, a positive electric potential of about 2 kV was applied to an extraction electrode opposed to the substrate at an interval of about 1 mm. As a result, it was confirmed that electrons were emitted from a surface where diamond particles were distributed to the extraction electrode. More specifically, it was observed that in the case where an applied voltage across the Au electrodes was about 150 volts, an electric current of about 0.5 mA flowed between the Au electrodes, and an electric current (emission current) of about 0.5 $\mu$A flowed from the extraction electrode. The emission efficiency was about 0.1%. Even when diamond particles of almost the same size are formed by a high-pressure synthesis method, electron emission cannot be confirmed. Therefore, it is considered that defects or a non-diamond component (which is considered to be present, in particular, on a crystalline interface) contained in the diamond film formed at a high speed in accordance with the present embodiment cause a mechanism of electron emission from the diamond particles (electron emission portions) formed in the present embodiment.

Embodiment 8

Next, as the eighth embodiment of the present invention, an electron emission element having a second basic structure which is different from that described in the first to seventh embodiments will be described below.

Figure 9A:
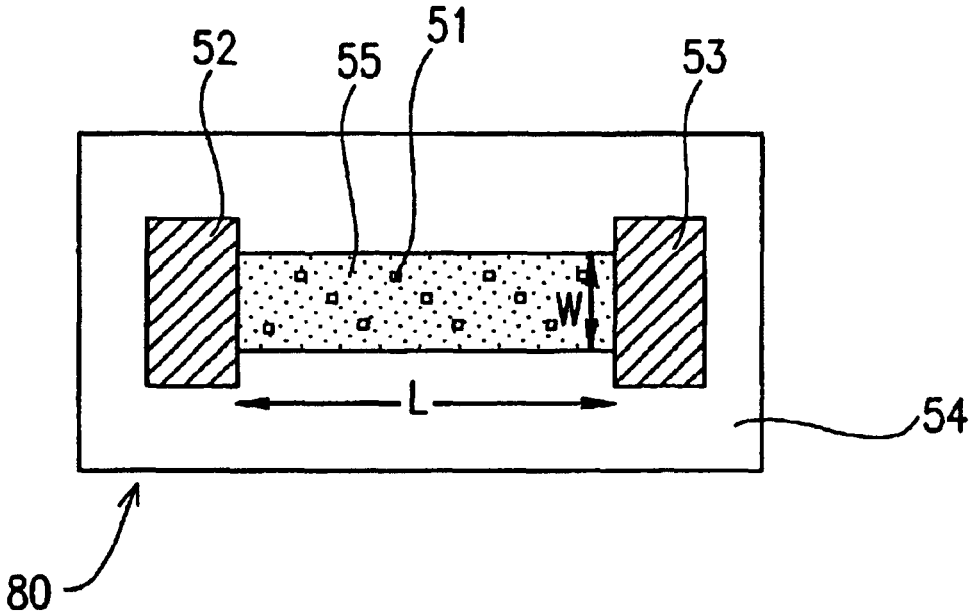
FIGS. 9A and 9B are a plan view and a cross-sectional view schematically showing a structure of an electron emission element having a second basic structure according to the present invention.
Figure 9B:
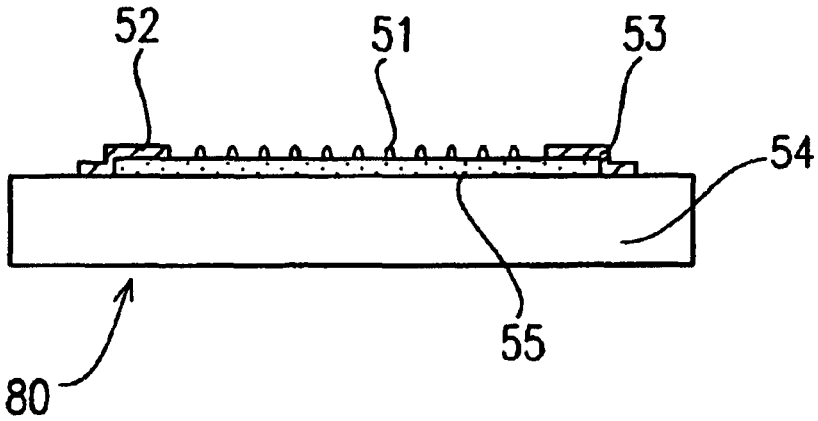

The second basic structure of the electron emission element according to the present invention includes at least two electrodes disposed at a predetermined interval, a conductive layer placed between the electrodes so as to be electrically connected to the electrodes, and a plurality of electron emission portions made of a particle or an aggregate of particles disposed dispersively on the surface of the conductive layer corresponding to between the electrodes. FIGS. 9A and 9B are a plan view and a side view schematically showing a structure of an electron emission element 80 in an embodiment in accordance with the second basic structure according to the present invention.

More specifically, in the structure of the electron emission element 80, a conductive layer 55 and two electrodes 52 and 53 disposed on both sides of the conductive layer 55 are formed on the surface of an insulating substrate 54. On the surface of the conductive layer 54 between the electrodes 52 and 53, a plurality of electron emission portions 51 each being made of a particle or an aggregate of particles are dispersed.

Figure 10:
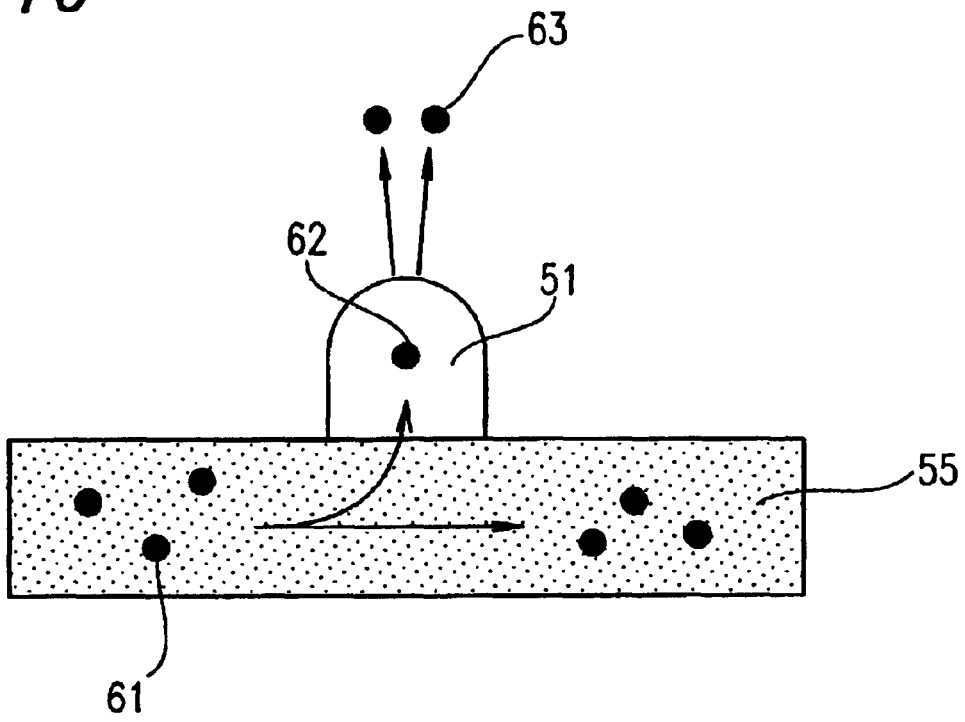
FIG. 10 is an enlarged cross-sectional view schematically showing the vicinity of an electron emission portion in the structure shown in FIGS. 9A and 9B, schematically showing an idea of electron emission in an electron emission element having a second basic structure according to the present invention.

FIG. 10 is a cross-sectional view showing the vicinity of the electron emission portion 51 of the electron emission element 80 in enlargement. Furthermore, FIG. 10 schematically shows an idea of electron emission in the electron emission element 80 in the present embodiment (second basic structure according to the present invention).

When a bias voltage is applied across the electrodes 52 and 53 shown in FIGS. 9A and 9B, a constant electric current flows in an in-plane direction of the conductive layer 55. The amount of an electric current depends upon the thickness and size of the conductive layer 55, or the electric resistance, etc. Typically, several parameters are set in such a manner that an electric current of about 1 mA to about 100 mA flows.

Due to the in-plane electric current in the conductive layer 55, electrons 61 move in the conductive layer 55, as schematically shown in FIG. 10. At this time, since the electron emission portion 51 is disposed, having a structure (e.g., energy band state) which is likely to allow electrons to be emitted, part of the electrons 61 moving in the conductive layer 55 are attracted to an inside or a surface layer (not shown) of the electron emission portion 51. Furthermore, electrons 62 which have thus entered the electron emission portion 51 are output due to a function of the energy band state of the electron emission portion 51 to become emission electrons 63. A plurality of electron emission portions 51 are disposed dispersively on the surface of the conductive layer 55 at an appropriate density, whereby a lot of electric current flowing through the inside of the conductive layer 55 can be output as the emission electrons 63 efficiently and uniformly. The amount of the emission electrons 63 to be output can be modified by controlling the amount of an electric current flowing in an in-plane direction of the conductive layer 55.

In FIG. 10, an output direction of the emission electrons 63 is schematically represented by upward arrows. However, the emission electrons are not always emitted in a direction substantially vertical to the surface of the insulating substrate 55 or in a direction close thereto. As described in the first embodiment related to the first basic structure, when a third electrode (extraction electrode) is provided so as to be opposed to the insulating substrate 54, and a positive bias voltage is applied to the third electrode, electrons are output substantially in one direction, and an output efficiency is enhanced. Furthermore, by combining various electrode arrangements described in the first embodiment, acceleration energy, an emission orbit, or the like of the emission electrons 63 can be controlled.

In the electron emission element 80 of the present embodiment, the emission electrons 63 can be obtained as described above only by allowing an electric current in an in-plane direction of the conductive layer 55. If the conductive layer 55 is heated at the same time as conduction of an electric current, thermal energy involved in heating will assist in allowing electrons to be emitted more efficiently. In this case, a preferable amount of an in-plane electric current in the conductive layer 55 is the same as the above. Furthermore, a preferable heating temperature depends upon the material, size, and the like of the conductive layer 55, which is typically set at about 300° C. to about 600° C. Heating for the above-mentioned purpose may be conducted by a mechanism (e.g. a heater layer, etc.) for heating the conductive layer 55 from outside or conducting an electric current through the conductive layer 55 to heat it with Joule heat generated by itself.

In the example shown in FIGS. 9A and 9B, the electrodes 52 and 53 are disposed so as to cover the ends of the conductive layer 55. However, the present invention is not limited thereto. It may be possible that the electrodes 52 and 53 are formed on the insulating substrate 54, and then, part of the conductive layer 55 is formed thereon. The number of the conductive layer 55 is not limited to one. A plurality of conductive layers can be disposed between the electrodes 52 and 53.

The conductive layer 55 is preferably made of metal or a material selected from an n-type semiconductor. Thus, the conductive layer 55 which allows an in-plane electric current with an appropriate level to flow can be relatively easily formed. In the case where the conductive layer 55 is made of metal, metal having a high melting point such as tungsten (W), platinum (Pt), and molybdenum (Mo) is preferable. On the other hand, in the case where the conductive layer 55 is made of an n-type semiconductor, a silicon type amorphous semiconductor (e.g., a-Si or a-SiC) or microcrystalline silicon ($\mu$c-Si), polycrystalline silicon (poly-Si), and the like are preferable. In the case where the conductive layer 55 is made of metal, formation of the electrodes 52 and 53 can be omitted.

A preferable range of an electric resistivity of the conductive layer 55 depends upon the size of the conductive layer 55, which is typically set at about $10^{-6}$ Ω·cm to about $10^{4}$ Ω·cm.

Furthermore, in the structure of the electron emission element 80, the thickness of the conductive layer 55 is preferably set at 100 nm or less. This enables the electrons 61 flowing through the inside of the conductive layer 55 to be efficiently transmitted to the electron emission portions 51. Furthermore, when the constituent material and shape of the conductive layer 55 are appropriately set in such a manner that the electric resistance in the entire conductive layer 55 becomes higher than that of the electron emission portions 51, the above-mentioned effect becomes more remarkable.

Due to the above-mentioned structure, electron emission can be realized. However, in order to obtain more efficient electron emission characteristics, it is important to select preferable structure and material of the electron emission portions 51. Therefore, in the present embodiment, in a manner similar to the case of the first basic structure, dispersed electron emission portions 51 are preferably made of diamond or a material (particles or aggregates of the particles) mainly containing diamond. The characteristics, effects, and the like related to this point have been described with reference to Embodiment 1 or the like, so that their description will be omitted here.

Furthermore, various electrode structures (electrodes 52 and 53, and an additional electrode provided for the other purpose), and various modifications of an arrangement of electron emission portions described in relation to the first embodiment can be applied to the structure of the electron emission element 80 described above. The characteristics and effects obtained in this case have also been described, so that their descriptions will be omitted here.

Embodiment 9

Next, as a ninth embodiment of the present invention, a method for producing an electron emission element having the basic structure described in the eighth embodiment will be described with reference to FIGS. 9A and 9B.

More specifically, a substrate 54 is first prepared. Although a constituent material for the substrate 54 is not particularly limited, quartz glass is used below. As a conductive layer 55, an n-type microcrystalline silicon ($\mu$c-Si) layer 55 is formed on the silica glass substrate 54 to a thickness (typically, about 200 nm) by a plasma CVD method, for example. The conductive layer 55 may be formed by another process.

Then, the conductive layer ($\mu$c-Si layer) 55 is patterned by photolithography and etching steps. A pattern size is appropriately selected; however, in the present embodiment, a rectangular pattern with a width of W=50 $\mu$m and a length of L=5 $\mu$m is formed.

Next, the conductive layer ($\mu$c-Si layer) 55 is coated with a solution in which diamond particles having an average particle diameter of about 0.1 $\mu$m are dispersed. For example, a solution in which about 1 g of diamond particles are dispersed in about 1 liter of pure water is applied by a spin coating method. Thereafter, the substrate 54 is dried by infrared heating. When the surface of the conductive layer 55 is observed at the completion of the process up to here, diamond particles and aggregates of diamond particles are uniformly distributed at a distribution density of about $5\times10^{8}/cm^{2}$.

After the drying step, aluminum (Al) layers to be electrodes 52 and 53 are formed on both ends of the conductive layer 55. Thus, an electron emission element of the present embodiment can be formed. However, a constituent material for the electrodes 52 and 53 is not limited to Al.

Next, the results of an experiment for confirming the state where electrons are emitted from the electron emission element 80 formed as described above will be described. The experiment was conducted by using an evaluation apparatus shown in FIG. 11.

More specifically, the electron emission element 80 was placed in a vacuum container 92 with a vacuum degree of about $1\times10^{-7}$ Torr, and a bias voltage was applied across the electrodes 52 and 53 by a power source 96. Furthermore, a positive electric potential of about 1 kV was applied to an extraction electrode 91 opposed to the substrate 54 at an interval of about 1 mm by the power source 95. As a result, it was confirmed that electrons were emitted from a surface where diamond particles 51 were distributed to the extraction electrode 91. More specifically, according to measurement using electric current meters 93 and 94, it was observed that in the case where an applied voltage across the electrodes 52 and 53 was about 10 volts, an electric current of about 100 $\mu$A flowed between the electrodes 52 and 53 (inside the conductive layer 55), and an electric current (emission current) of about 1 $\mu$A flowed from the extraction electrode 91.

When an applied voltage to the conductive layer 55 was varied in a range of about 1 volt to about 30 volts, the level of an electric current (emission current) output from the extraction electrode 91 was changed in accordance with the level of an electric current (element current) flowing through the conductive layer 55, and a ratio (emission efficiency) of the amount of an emission current to the amount of the element current was about 1%.

Figure 11:
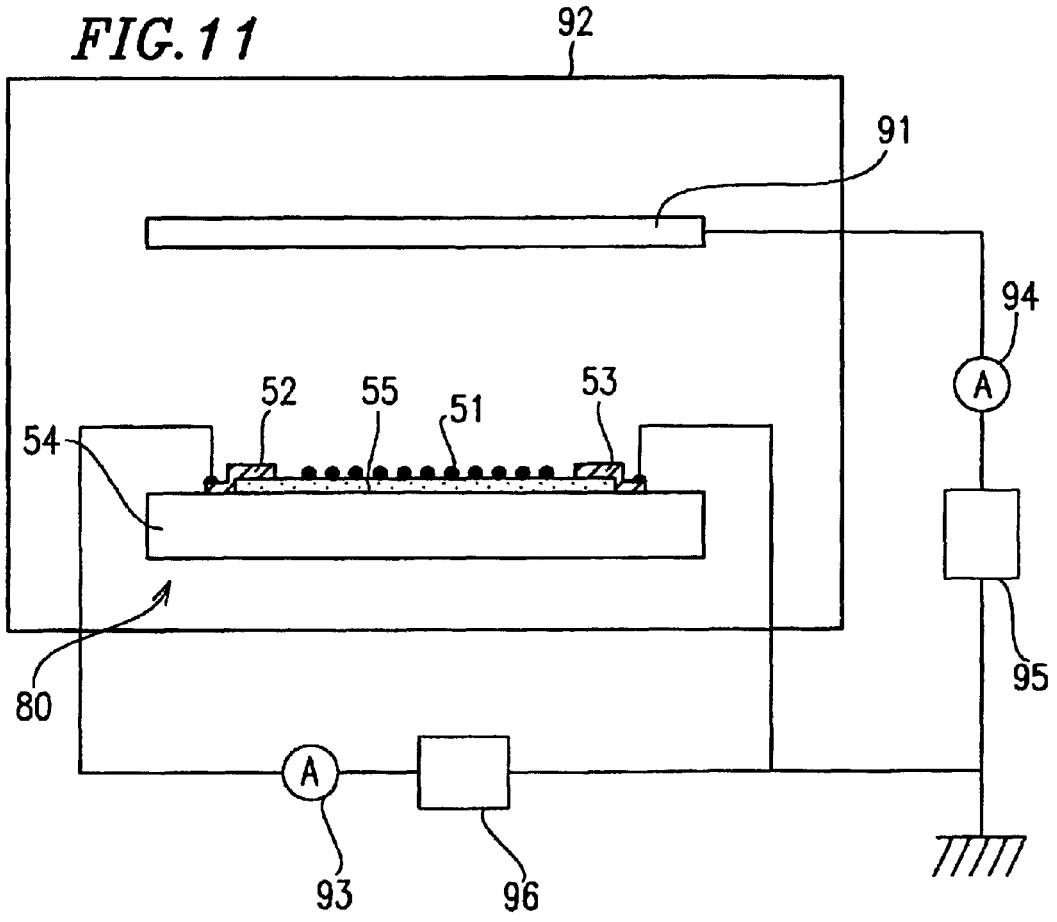
FIG. 11 is a view schematically showing a structure of an evaluation apparatus of an electron emission element having a second basic structure according to the present invention.

Furthermore, for comparison, under the condition that a voltage was not applied across the electrodes 52 and 53 (i.e., under the condition that an electric current was not flowing through the conductive layer 55), the measurement similar to that of the above was conducted with respect to an electron emission element produced in the process similar to the above by using the apparatus shown in FIG. 11. An electron emission current was not detected. Furthermore, a comparative sample was prepared, in which diamond particles were distributed on the conductive layer 55 (the other structure is the same as that of the electron emission element 80 in the present embodiment), and the measurement similar to the above was conducted by the apparatus shown in FIG. 11 while a voltage of about 10 volts was applied across the electrodes 52 and 53. As a result, an electric current of about 100 $\mu$A flowed in the manner similar to the above, whereas an emission current was not detected from the extraction electrode 91. It was confirmed from the above that the presence of an in-plane electric current in the conductive layer 55 and the electron emission portions 51 (diamond particles or aggregates of the diamond particles) on the surface of the conductive layer 55 is necessary for an electron emission mechanism in the second basic structure according to the present invention.

Even by directly spraying diamond particles onto the conductive layer or by using another process (e.g., ultrasonic treatment or voltage application in the solution) utilizing a solution in which diamond particles are dispersed, instead of applying the above-mentioned solution in which diamond particles are dispersed, an electron emission element having the effect similar to the above can be obtained. Furthermore, even when the particle diameter and the distribution density of the diamond particles are varied, an effect substantially the same as the above can be obtained.

Even by using a material (e.g., particle-shaped boron nitride (BN), etc.) other than diamond, which is likely to emit electrons for an electron emission portion, results substantially similar to the above can be obtained.

Embodiment 10

Next, as the tenth embodiment, the case where a material for the conductive layer 55 is changed will be described below. In the present embodiment, the substrate 54 to be used, and the material and distribution method of diamond particles used for the electron emission portions 51 are the same as those in Embodiment 9.

In the present embodiment, as a material for the conductive layer 55, tungsten (W) layer with a thickness of about 100 nm formed by electron beam vapor deposition is used. In the same way as in the ninth embodiment, the W layer is patterned to a rectangular pattern, for example, having a width of W=about 10 $\mu$m and a length L=about 200 $\mu$m in ordinary photolithography and etching steps. Herein, in the present embodiment, the conductive layer 55 itself is metal, and it is not required that the electrodes 52 and 53 are formed as separate elements. During patterning of the W layer, patterns for wiring (size=about 500 $\mu$m×about 500 $\mu$m) which function as electrode portions are simultaneously formed on both ends of a portion which functions as the conductive layer 55. The conductive layer (W layer) thus patterned is coated with a solution in which diamond particles with an average particle diameter of about 0.1 $\mu$m are dispersed, in the same way as the above.

The electron emission element formed as described above was evaluated by using the apparatus shown in FIG. 11 described above. The evaluation condition is the same as described in the ninth embodiment. As a result, it was confirmed that electrons were emitted from a surface where the diamond particles were distributed to the extraction electrode. More specifically, it was observed that in the case where an applied voltage to the conductive layer was about 1 volt, an electric current of about 40 mA flowed through the conductive layer, and an electric current (emission current) of about 40 $\mu$A flowed from the extraction electrode. Furthermore, when an applied voltage to the conductive layer was varied, the level of an electric current (emission current) output from the extraction electrode was changed in accordance with the level of an electric current (element current) flowing through the conductive layer, and a ratio (emission efficiency) of the amount of an emission current to the amount of the element current was about 0.1%.

Furthermore, when the same evaluation test as the above was conducted under the condition that the conductive layer made of W was heated to about 350° C., thermal energy assisted in facilitating electron emission. Therefore, the emission efficiency was increased up to about 0.5%.

Even by directly spraying diamond particles onto the conductive layer or by using another process (e.g., ultrasonic treatment or voltage application in the solution) utilizing a solution in which diamond particles are dispersed, instead of applying the above-mentioned solution in which diamond particles are dispersed, an electron emission element having the effect similar to the above can be obtained. Furthermore, even when the particle diameter and the distribution density of the diamond particles are varied, an effect substantially the same as the above can be obtained.

Even by using a material (e.g., particle-shaped boron nitride (BN), etc.) other than diamond, which is likely to emit electrons for an electron emission portion, results substantially similar to the above can be obtained.

Embodiment 11

Next, as the eleventh embodiment, a method for producing an electron emission element having the second basic structure according to the present invention will be described, which includes a step of conducting pre-treatment to diamond particles to be used. In the present embodiment, the materials for the substrate 54 and the conductive layer 55 to be used, and the distribution method of diamond particles used for the electron emission portions 51 are the same as those in the ninth embodiment.

In the present embodiment, a conductive layer ($\mu$c-Si layer) is coated with a solution in which diamond particles with an average particle diameter of about 0.1 $\mu$m, and diamond particles are dispersed on the surface of the conductive layer in the same way as in the ninth embodiment. Thereafter, aluminum layers (Al) to be electrodes are formed on both ends of the conductive layer. In the present embodiment, diamond particles are used, which are subjected to heat-treatment at about 600° C. for about 3 hours in a hydrogen atmosphere. According to the study by the inventors of the present invention, it was confirmed that the surfaces of the diamond particles on the conductive layer obtained in the above method were terminated by binding to hydrogen atoms, and an amount of hydrogen atoms was about $1.5\times10^{15}/cm^2$.

The electron emission element formed as described above was evaluated by using the apparatus shown in FIG. 11 described above. The evaluation condition is the same as described in the ninth embodiment. As a result, it was confirmed that electrons were emitted from a surface where the diamond particles were distributed to the extraction electrode. More specifically, it was observed that in the case where an applied voltage to the conductive layer was about 10 volts, an electric current of about 100 μA flowed through the conductive layer, and an electric current (emission current) of about 1.5 μA flowed from the extraction electrode. Thus, in the present embodiment, by controlling a surface state of diamond particles which function as the electron emission portions, electron emission which is more efficient than the case of the above-mentioned embodiments can be realized.

Embodiment 12

Next, as the twelfth embodiment, a method for producing an electron emission element having the second basic structure according to the present invention will be described, which includes a step of conducting another pre-treatment to diamond particles to be used. In the present embodiment, the materials for the substrate 54 and the conductive layer 55 to be used, and the distribution method of diamond particles used for the electron emission portions 51 are the same as those in the ninth embodiment.

In the present embodiment, a conductive layer (μc-Si layer) is coated with a solution in which diamond particles with an average particle diameter of about 0.1 μm, and diamond particles are dispersed on the surface of the conductive layer in the same way as in the ninth embodiment. Thereafter, aluminum layers (Al) to be electrodes are formed on both ends of the conductive layer. In the present embodiment, diamond particles are used, into which crystal defects are introduced by implanting ions onto the surface layers. More specifically, for example, carbon (c) ions or boron (B) ions are implanted at an acceleration energy of about 40 keV so as to obtain a dose amount of about $5\times10^{13}/cm^2$. According to the study by the inventors of the present invention, it was confirmed that crystal defects of about $1\times10^{20}/cm^3$ were introduced onto the surface layers (thickness: about 50 nm) of the diamond particles on the conductive layer obtained by the above method.

The electron emission element formed as described above was evaluated by using the apparatus shown in FIG. 11 described above. The evaluation condition is the same as described in the ninth embodiment. As a result, it was confirmed that electrons were emitted from a surface where the diamond particles were distributed to the extraction electrode. More specifically, it was observed that in the case where an applied voltage to the conductive layer was about 10 volts, an electric current of about 100 μA flowed through the conductive layer, and an electric current (emission current) of about 2 μA flowed from the extraction electrode. Thus, in the present embodiment, by controlling a surface state of diamond particles which function as the electron emission portions, electron emission which is more efficient than the case of the above-mentioned embodiments can be realized.

Embodiment 13

Next, as the thirteenth embodiment of the present invention, a production method for forming the second basic structure according to the present invention will be described, in which a W layer patterned as in Embodiment 10 is formed, diamond particles are disposed on the W layer, and diamond is additionally grown using the diamond particles as cores. In the present embodiment, the materials for the substrate 54 and the conductive layer 55 to be used, and the distribution method of diamond particles used for the electron emission portions 51 are the same as those in the ninth embodiment.

In the present embodiment, a W layer patterned as in Embodiment 10 is formed, and diamond particles with an average particle diameter of about 0.1 μm are dispersed. Thereafter, a diamond layer is additionally grown on the diamond particles distributed on the W layer. A synthesis method for additionally growing the diamond layer is not particularly limited. In the present embodiment, diamond is additionally grown by a microwave plasma CVD method in which diamond is formed by generating plasma from material gas with a microwave. More specifically, carbon monoxide (CO) gas diluted with hydrogen ($H_2$) to about 1 vol % to about 10 vol % is used as material gas, the reaction temperature and the pressure are set to be about 800° C. to about 900° C. and about 25 Torr to about 40 Torr, respectively, and the growth time is set to be about one minute to about three minutes.

In accordance with the above method, a diamond layer is newly formed (additionally grown) on the diamond particles dispersed on the W layer by vapor-phase synthesis; as a result, the size of the diamond particles disposed on the W layer which is a conductive layer becomes about 0.2 μm to about 0.5 μm. Furthermore, according to the study by the inventors of the present invention, it was confirmed that the surfaces of the diamond particles on the W layer obtained by the above method were terminated by binding to hydrogen atoms.

The electron emission element formed as described above was evaluated by using the apparatus shown in FIG. 11 described above. The evaluation condition is the same as described in the ninth embodiment. As a result, it was confirmed that electrons were emitted from a surface where the diamond particles were distributed to the extraction electrode. More specifically, it was observed that in the case where an applied voltage to the conductive layer was about 1 volt, an electric current of about 40 mA flowed through the conductive layer, and an electric current (emission current) of about 60 μA flowed from the extraction electrode. Thus, in the present embodiment, by controlling a surface state of diamond particles which function as the electron emission portions, electron emission which is more efficient than the case of the above-mentioned embodiments can be realized.

Embodiment 14

Figure 12:
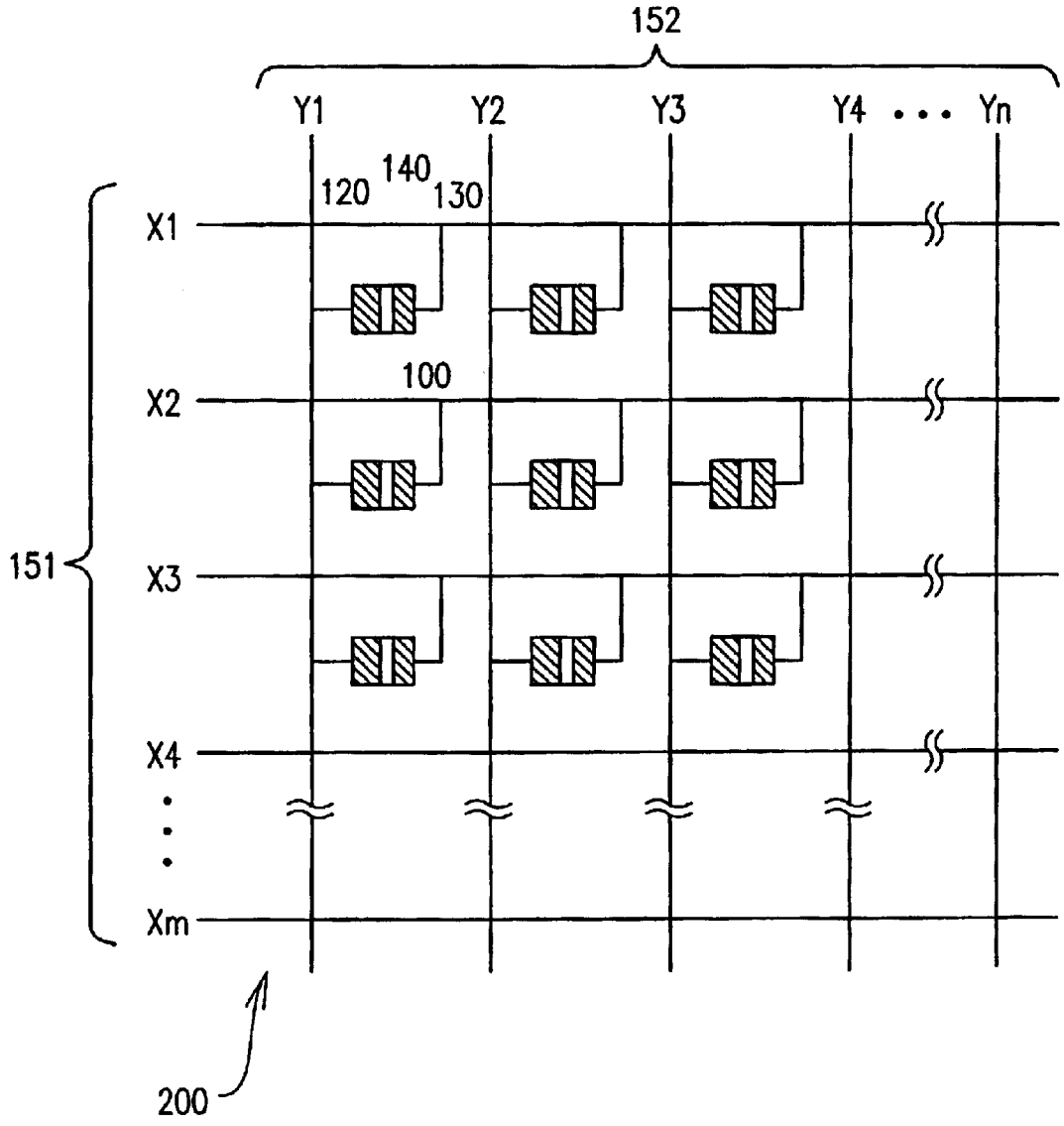
FIG. 12 is a view schematically showing a structure of an electron emission source formed by using an electron emission element according to the present invention.

Next, as the fourteenth embodiment of the present invention, an electron emission source which is constructed by using a plurality of electron emission elements according to the present invention described above will be described. FIG. 12 schematically shows a structure of the electron emission source 200 in the present embodiment.

In the electron emission source 200, a plurality of X-direction lines (X1 to Xm) 151 electrically insulated from each other are disposed so as to be orthogonal to a plurality of Y-direction lines (Y1 to Yn) 152 electrically insulated from each other. An electron emission element 100 according to the present invention is disposed in the vicinity of each intersection of the X-direction lines 151 and the Y-direction lines 152. In this case, electrodes 130 and 120 included in each electron emission element 100 are electrically connected to the corresponding X-direction line 151 and the corresponding Y-direction line 152. Thus, a plurality of electron emission elements 100 are two-dimensionally arranged in a simple matrix. Electrons are emitted from a region 140 between the electrodes 120 and 130.

The numbers (i.e., values of m and n) of the X-direction lines 151 and the Y-direction lines 152 are not limited to particular values. For example, m and n may be the same number (e.g., 16×16), or m and n may be different numbers.

According to the structure of the electron emission source 200 shown in FIG. 12, the total amount of electron emission can be controlled, with a voltage applied to individual electrodes 120 and 130 of each electron emission element 100 being an input signal. In this case, by varying the number of the electron emission elements 100 to which a voltage is applied as an input signal, and the value of a voltage applied to each electron emission element 100, the amount of electron emission can be modulated.

Furthermore, the electron emission source 200 having a structure shown in FIG. 12 has a high electron emission efficiency and a small change in amount of electron emission with passage of time, compared with the structure of the prior art.

Furthermore, when an input signal having a distribution in the X-direction and the Y-direction is supplied to the electron emission element 100 in a two-dimensional arrangement in the structure shown in FIG. 12, an electron emission distribution corresponding to the distribution of the input signal can be obtained.

Accordingly, the electron emission source 200 of the present embodiment has a plurality of high-efficiency electron emission elements 100, so that a large electron emission current can be obtained with a small electric power. Furthermore, an electron emission region can be enlarged. Furthermore, since the amount of electron emission from the individual electron emission elements 100 can be controlled in accordance with an input signal, an arbitrary electron emission distribution can be obtained.

Embodiment 15

Figure 13:
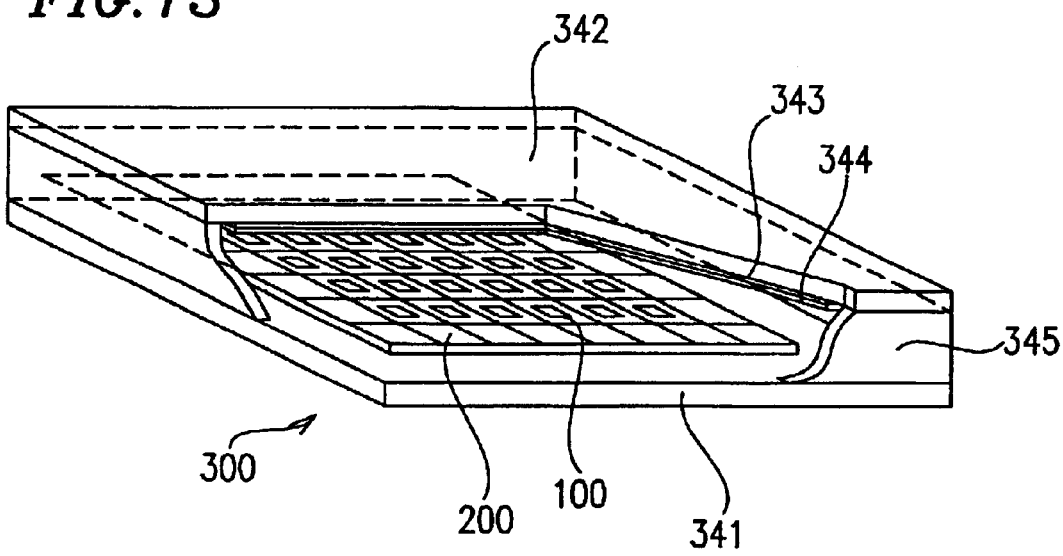
FIG. 13 is a view schematically showing a structure of an image display apparatus formed by using an electron emission element according to the present invention.

In the present embodiment, an image display apparatus 300 including a fluophor emitting light will be described, which is formed by using the electron emission source 200 produced in Embodiment 14 described above. FIG. 13 is a schematic view showing a structure of the image display apparatus 300 of the present embodiment.

The image display apparatus 300 in FIG. 13 includes an electron emission source 200 (see Embodiment 14) in which electron emission elements 100 according to the present invention are arranged in a simple matrix. In this case, as described in the previous embodiments, the individual electron emission elements 100 included in the electron emission source 200 can be selectively and independently driven. The electron emission source 200 is fixed onto a back plate 341, and the face plate 342 is supported by a side plate 345, whereby an enclosure is formed. An inner surface of the face plate 342 (surface opposed to the back plate 341) has a transparent electrode 343 and a fluophor 344.

The enclosure composed of the face plate 342, the back plate 341, and the side plate 345 needs to maintain a vacuum therein. Thus, each connecting portion between the plates is sealed against a vacuum leakage. In the present embodiment, frit glass is sintered at a temperature of about 500° C. in a nitrogen atmosphere and allowed to adhere for sealing. After adhesion for sealing, an inside of the enclosure formed of each plate is evacuated by an oil-less vacuum pump such as an ion pump with heating, if required, until a high vacuum environment of about $1\times10^{-7}$ Torr or more is obtained. Thereafter, the enclosure is finally sealed. In order to retain this degree of vacuum, a getter (not shown) is disposed in the enclosure.

The fluophor 344 on the inner surface of the face plate 342 is arranged in a black stripe. For example, the fluophor 344 is formed by printing. On the other hand, the transparent electrode 343 functions as an extraction electrode which applies a bias voltage for accelerating emitted electrons. For example, the transparent electrode 343 is formed by RF sputtering.

Alternatively, as a structure for accelerating emitted electrons, there is a method for providing a very thin metal back on the surface of the fluophor 344, instead of providing the transparent electrode (extraction electrode) 343. In this structure, the effect of the present embodiment can also be effectively obtained.

In the image display apparatus 300 with such a structure, a predetermined input signal is applied to each electron emission element 100 through the X-side lines and the Y-side lines (see FIG. 12 in Embodiment 14) from an external predetermined driving circuit (not shown). Thus, electron emission from each electron emission element 100 is controlled, and the fluophor 343 is allowed to emit light in a predetermined pattern with emitted electrons. Thus, an image display apparatus such as a flat panel display can be obtained, which is capable of displaying a high-definition image with high brightness.

The enclosure formed between the plates is not limited to the structure described above. For example, in order to keep sufficient strength against atmospheric pressure, a support may be further disposed between the face plate 342 and the back plate 341. Furthermore, in order to further enhance a focusing property of an emitted electron beam, a focus electrode (electrode for controlling focusing) may be disposed between the electron emission source 200 and the face plate 342.

As described above, the image display apparatus 300 in the present embodiment at least includes the electron emission source 200 including a plurality of electron emission elements 100, an image forming member such as the fluophor 344, and the enclosure for retaining the electron emission source 200 and the image forming member in a vacuum state, wherein electrons emitted from the electron emission source (each electron emission element 100) in accordance with an input signal are accelerated to irradiate the image forming member (fluophor 344), thereby forming an image. In particular, by disposing the electron emission source of the present invention capable of emitting electrons with high efficiency and high stability, a fluophor is allowed to emit light with good controllability and high brightness.

INDUSTRIAL APPLICABILITY

As described above, according to the present invention, an electron emission element with high stability is obtained, in which electrons can be emitted efficiently and uniformly even in the absence of a bias voltage (electric field) from outside in the output (emission) direction of electrons, utilizing a transverse electric field generated between electrodes disposed in a horizontal direction at a predetermined interval or an in-plane electric current flowing through a conductive layer disposed between the electrodes. Furthermore, if an appropriate extraction electrode is provided, and an appropriate bias voltage (electric field) is applied thereto, the output (emission) direction of electrons toward an outside can be aligned substantially in one direction, and the output (emission) efficiency of the electrodes toward an outside can be enhanced. Furthermore, by appropriately setting the structure and shape of electrodes, or by providing an additional electrode, it is possible to control the orbit of electrons to be emitted and the diameter and the focusing property of an electron beam to be obtained.

If the electron emission portion is made of diamond or a material (particles or aggregates of the particles) mainly containing diamond, an electron emission portion with high stability can be obtained. Furthermore, by appropriately controlling the surface state of particles and the like and the state of defects and the like, more efficient and stable electron emission can be realized.

Furthermore, when a plurality of electron emission elements according to the present invention are used, and disposed, for example, in a two-dimensional array, an electron emission region can be enlarged. Furthermore, in this case, if an electric connection state to each electron emission element is appropriately set, the amount of electron emission of each electron emission element can be controlled in accordance with an input signal, and it becomes possible to obtain an arbitrary electron emission distribution and reduce power consumption.

Furthermore, by combining the above-mentioned electron emission element (electron emission source) with the image forming member for forming an image upon receiving electrons, an image display apparatus (e.g., flat panel display) is constructed, which allows the image forming member to emit light with good controllability and high brightness.

On the other hand, according to the method for producing an electron emission element of the present invention, electron emission portions made of particles or aggregates of the particles can easily be dispersed with uniformity and high density; thus, a high-efficiency electron emission element can easily be formed.

Furthermore, according to the present invention, diamond which is very suitable as a constituent material for the electron emission portion can be disposed on a predetermined surface with good controllability at any density in the form of micro-particles or aggregates thereof capable of functioning as the electron emission portion. Therefore, a high-efficiency electron emission element can easily be formed.

What is claimed is:

1. A method for producing an electron emission element, comprising:

an electrode forming step of disposing a pair of electrodes in a horizontal direction at a predetermined interval on a substrate having an insulating surface; and a dispersively disposing step of disposing a plurality of particles mainly containing diamond, atoms on an outermost surface of which are terminated by binding to hydrogen atoms, or a plurality of aggregates of the particles between the pair of electrodes so as to be independent relative to one another without coming into contact with one another, wherein the particles or aggregates of particles have a density of $1\times10^{10}/cm^2$ or more between the pair of electrodes.

2. A method for producing an electron emission element according to claim 1, wherein an interval between adjacent particles or the aggregates of particles is less than 0.1 $\mu$m.

3. A method for producing an electron emission source, comprising the steps of:

arranging a plurality of electron emission elements in a predetermined pattern in such a manner that the electron emission elements emit electrons in accordance with an input signal to each of the electron emission elements; and forming each of the plurality of electron emission elements by the production method of claim 1.

4. A method for producing an electron emission source according to claim 3, comprising the steps of:

disposing a plurality of lines in a first direction electrically insulated from each other and a plurality of lines in a second direction electrically insulated from each other in such a manner that the plurality of lines in the first direction and the plurality of lines in the second direction are orthogonal to each other; and disposing each of the electron emission elements in the vicinity of each intersection between the lines in the first direction and the lines in the second direction.

5. A method for producing an image display apparatus, comprising the steps of;

constructing an electron emission source; and disposing an image forming member for forming an image upon irradiation with electrons emitted from the electron emission source, wherein the electron emission source is constructed by the production method of claim 3.

6. A method for producing an electron emission element according to claim 1, wherein the dispersively disposing stop includes the steps of: applying a solution or a solvent in which diamond particles are dispersed; and removing the solution or the solvent.

7. A method for producing an electron emission element according to claim 6, wherein the dispersively disposing step includes the step of applying an ultrasonic vibration in a solution or a solvent in which the diamond particles are dispersed.

8. A method for producing an electron emission element according to claim 6, wherein the amount of the diamond particles dispersed in the solution is about 0.01 g to about 100 g per liter of the solution.

9. A method for producing an electron emission element according to claim 6, wherein the number of the diamond particles dispersed in the solution is about $1\times10^{16}$ to about $1\times10^{20}$ per liter of the solution.

10. A method for producing an electron emission element according to claim 6, wherein a pH value of the solution in which the diamond particles are dispersed is about 7 or less.

11. A method for producing an electron emission element according to claim 6, wherein the solution in which the diamond particles are dispersed contains at least fluorine atoms.

12. A method for producing an electron emission element according to claim 6, wherein the solution in which the diamond particles are dispersed contains at least hydrofluoric acid or ammonium fluoride.

13. A method for producing an electron emission element according to claim 6, further comprising the step of allowing atoms on an outermost surface of the diamond particles to bind to hydrogen atoms.

14. A method for producing an electron emission element according to claim 13, wherein diamond particles heat-treated at about 600° C. or more in an atmosphere containing hydrogen gas are used in the hydrogen binding step.

15. A method for producing an electron emission element according to claim 13, wherein the hydrogen binding step includes the step of heating the diamond particles at 600° C. or more in an atmosphere containing hydrogen or the step of irradiating the diamond particles with ultraviolet light.

16. A method for producing en electron emission element according to claim 13, wherein the hydrogen binding step includes the step of exposing the diamond particles to plasma containing at least hydrogen under a state where a temperature of the diamond particles is about 300° C. or more.

17. A method for producing an electron emission element according to claim 6, further comprising the step of introducing crystal defects into the diamond particles.

18. A method for producing an electron emission element according to claim 17, wherein diamond particles of which surfaces are irradiated with accelerated particles are used in the defect introducing step.

19. A method for producing an electron emission element according to claim 17, wherein the defect introducing step includes the step of irradiating the diamond particles with accelerated atoms.

20. A method for producing an electron emission element according to claim 6, further comprising the step of additionally growing diamond on the dispersed diamond particles.

21. A method for producing an electron emission element according to claim 20, wherein a vapor-phase synthesis process of diamond is used in the additional growth step.

22. A method for producing an electron emission element, comprising:

an electrode forming step of disposing a pair of electrodes in a horizontal direction at a predetermined interval on a substrate having an insulating surface; and a conductive layer forming step of providing a conductive layer between the pair of electrodes which is electrically connected to the pair of electrodes; and a dispersively disposing step of disposing a plurality of particles mainly containing diamond, atoms on an outermost surface of which are terminated by binding to hydrogen atoms, or a plurality of aggregates of the particles on the conductive layer so as to be independent relative to one another without coming into contact with one another, wherein a thickness of the conductive layer is 100 nm or less and an electric resistivity of the conductive layer is within a range of $10^{-5}$ Ω·m to $10^{4}$ Ω·m.

23. A method for producing an electron emission element according to claim 22, wherein the pair of electrodes are provided as partial regions on ends of the conductive layer.

24. A method for producing an electron emission element according to claim 22, wherein the pair of electrodes and the conductive layer are made of different materials.

25. A method for producing an electron emission element according to claim 22, wherein the dispersively disposing step includes the steps of: applying a solution or a solvent in which diamond particles are dispersed; and removing the solution or the solvent.

26. A method for producing an electron emission source, comprising the steps of: arranging a plurality of electron emission elements in a predetermined pattern in such a manner that the electron emission elements emit electrons in accordance with an input signal to each of the electron emission elements; and forming each of the plurality of electron emission elements by the production method of claim 22.

* * * * *